US008144095B2

(12) United States Patent
Nukiyama et al.

(10) Patent No.: US 8,144,095 B2
(45) Date of Patent: Mar. 27, 2012

(54) IMAGE DISPLAY DEVICE, DISPLAY PANEL AND METHOD OF DRIVING IMAGE DISPLAY DEVICE

(75) Inventors: Kazuhiro Nukiyama, Kanagawa (JP); Toshiaki Suzuki, Kanagawa (JP); Tsuyoshi Kamada, Kanagawa (JP)

(73) Assignee: Sony Corporation, Tokyo (JP)

( * ) Notice: Subject to any disclaimer, the term of this patent is extended or adjusted under 35 U.S.C. 154(b) by 1028 days.

(21) Appl. No.: 12/062,071

(22) Filed: Apr. 3, 2008

(65) Prior Publication Data

US 2008/0246714 A1 Oct. 9, 2008

(30) Foreign Application Priority Data

Apr. 4, 2007 (JP) ..... P2007-098420

(51) Int. Cl.
*G09G 3/36* (2006.01)

(52) U.S. Cl. ..... 345/89; 345/87

(58) Field of Classification Search ..... 345/89, 345/84, 87

See application file for complete search history.

(56) References Cited

U.S. PATENT DOCUMENTS

| | | | | |
|---|---|---|---|---|
| 6,115,018 | A * | 9/2000 | Okumura et al. | 345/95 |
| 2002/0084969 | A1* | 7/2002 | Ozawa | 345/96 |
| 2005/0083279 | A1* | 4/2005 | Lee et al. | 345/87 |
| 2005/0156858 | A1* | 7/2005 | Ahn et al. | 345/100 |
| 2006/0044247 | A1* | 3/2006 | Jang et al. | 345/98 |
| 2006/0164354 | A1* | 7/2006 | Lee et al. | 345/89 |
| 2006/0284811 | A1* | 12/2006 | Huang | 345/92 |
| 2008/0062340 | A1* | 3/2008 | Um et al. | 349/38 |

FOREIGN PATENT DOCUMENTS

JP 2003-330044 11/2003

* cited by examiner

*Primary Examiner* — Quan-Zhen Wang
*Assistant Examiner* — David Lee
(74) *Attorney, Agent, or Firm* — Oblon, Spivak, McClelland, Maier & Neustadt, L.L.P.

(57) ABSTRACT

An image display device applies a higher voltage than the original voltage to the pixel, without causing deterioration of the display quality. The image display device includes a plurality of pixels each including a main capacitive element as a display element performing display operation in accordance with image data supplied to one end thereof. An auxiliary capacitive element has one end connected to the one end of the main capacitive element. A drive circuit drives each of the pixels, while supplying an additional potential to the other end of the auxiliary capacitive element in each of the pixels. The additional potential is individually determined so that a voltage between both ends of the main capacitive element rises higher than an original voltage.

18 Claims, 18 Drawing Sheets

| D1p | D1c | DCS | |
|---|---|---|---|
| 0/63 | 63/63 | 1 | 1 |
| | 62/63 | 1 | 0 |
| | 60/63, 61/63 | 0 | 1 |
| 1/63 | 63/63 | 1 | 0 |
| | 62/63 | 0 | 1 |
| 2/63～4/63 | 63/63 | 0 | 1 |
| OTHER | | 0 | 0 |

FIG. 3

| DCS | | Dpm | Vout |
|---|---|---|---|
| 1 | 1 | + | Vcsp |
| 1 | 0 | | Vcs+2/3 × (Vcsp−Vcs) |
| 0 | 1 | | Vcs+1/3 × (Vcsp−Vcs) |
| 0 | 0 | | Vcs |
| 0 | 0 | − | Vcs |
| 0 | 1 | | Vcs−1/3 × (Vcs−Vcsn) |
| 1 | 0 | | Vcs−2/3 × (Vcs−Vcsn) |
| 1 | 1 | | Vcsn |

FIG. 4

IMAGE DISPLAY DEVICE, DISPLAY PANEL AND METHOD OF DRIVING IMAGE DISPLAY DEVICE

CROSS REFERENCES TO RELATED APPLICATIONS

The present invention contains subject matter related to Japanese Patent Application JP 2007-098420 filed in the Japanese Patent Office on Apr. 4, 2007, the entire contents of which being incorporated herein by reference.

BACKGROUND OF THE INVENTION

1. Field of the Invention

The present invention relates to an image display panel and an image display device, each having pixels including an auxiliary capacitive element, as well as a method of driving the image display device.

2. Description of the Related Art

Recently, image display devices (liquid crystal displays) performing image display by driving pixels using liquid crystal have been widely used. In these liquid crystal displays, the light from a light source is transmitted and modulated by changing the alignment of liquid crystal molecules in a liquid crystal layer sealed between substrates composed of glass or the like.

These liquid crystal displays include an auxiliary capacitive element for stabilizing the voltage applied to the liquid crystal in each pixel (for example, refer to Japanese Unexamined Patent Application Publication No. 2003-330044).

SUMMARY OF THE INVENTION

In some cases, it is desired for the liquid crystal displays that a larger voltage (overvoltage) than the breakdown voltage of a driving element is applied to a pixel. For example, the liquid crystal displays have different display modes depending on the liquid crystal material constituting the liquid crystal layer. In a VA (vertical alignment) mode liquid crystal display using vertical alignment liquid crystal capable of realizing a wide view angle, it is considered to increase the response speed by applying overvoltage when causing a transition from black display state to white display state. Due to orientation changes in the liquid crystal during this transition, the capacity component of the liquid crystal becomes large, resulting in a low response speed. Since a higher voltage than the breakdown voltage of the driving element may not be applied, the power supply voltage and the breakdown voltage of the driving element is necessary to be set higher than their respective proper values. This may increase power consumption and heating value, thus deteriorating the reliability of the driving element.

It is therefore considered to apply overvoltage without increasing the power supply voltage and the breakdown voltage of the driving element, by using the method as described in the above publication No. 2003-330044. Specifically, the voltage applied to the auxiliary capacitive element is increased so that the voltage applied to the liquid crystal device may also become overvoltage by disposing a common bus line per scanning line on one electrode of an auxiliary capacitive element (on the electrode opposite a TFT (thin film transistor)), and by supplying a potential to the bus line via a switching element located outside of a display region.

With this method, however, by the batch voltage supply per scanning line, the overvoltage may also be uniformly applied to pixels that may require no overvoltage (those other than the pixels having the transition from black display state to white display state). Consequently, a voltage larger than the proper pixel voltage based on an image signal is applied to these pixels (data error may occur), and the luminance will be higher than the proper luminance value. This causes luminance variations in the display region, resulting in a low display quality.

Thus, in the related art, there are difficulties in applying a higher voltage than the original voltage value to the pixel, without causing deterioration of the display quality.

In view of the foregoing, it is desirable to provide an image display device, a display panel, and a method of driving the image display device, each capable of applying a higher voltage than the original voltage value to a pixel, without causing deterioration of the display quality.

According to an embodiment of the present invention, there is provided an image display device including a plurality of pixels and driving means. Each of the plurality of pixels includes a main capacitive element as a display element performing display operation in accordance with image data supplied to one end thereof, and an auxiliary capacitive element having one end connected to one end of the main capacitive element. The driving means drives each of the pixels, while supplying an additional potential to the other end of the auxiliary capacitive element in each of the pixels, the additional potential being individually determined so that a voltage between both ends of the main capacitive element rises higher than an original voltage.

According to an embodiment of the present invention, there is provided a display panel having a plurality of pixels arranged side by side, each including a main capacitive element as a display element performing display operation in accordance with image data supplied to one end thereof, and an auxiliary capacitive element having one end connected to the one end of the main capacitive element. The other end of the auxiliary capacitive element in each of the pixels is supplied with an additional potential which is individually determined so that a voltage between both ends of the main capacitive element rises higher than an original voltage.

In the image display device or the display panel of the embodiment of the present invention, at the time of the display driving of the pixels, the additional potential is supplied to the other end of the auxiliary capacitive element. Therefore, in these pixels, the voltage between both ends of the main capacitive element is increased than the original voltage value. Unlike the related art where the batch power supply per scanning line is performed to the other end of the auxiliary capacitive element, the additional potential is supplied per auxiliary capacitive element, enabling the adaptive power supply per auxiliary capacitive element, namely, per pixel. The term "the original voltage value" means a pixel voltage value based on an image signal, in other words, a voltage value for expressing a luminance level set to a target pixel.

In the image display device of the embodiment of the present invention, the driving means may supply polarity of the additional potential different from polarity of a potential at the one end of the main capacitive element. With this configuration, the different polarity potential from the potential of the main capacitive element is supplied to the other end of the auxiliary capacitive element, making it possible to raise the voltage between both ends of the main capacitive element, than the original voltage value.

In the image display device of the embodiment of the present invention, polarity of the additional potential is different from polarity of a potential at the one end of the main capacitive element. With this configuration, the additional potential is supplied to the other end of the auxiliary capacitive element within the pixel in accordance with the image data, enabling the adaptive power supply per pixel in accordance with a display image.

In the image display device of the embodiment of the present invention, the main capacitive element may be configured of a liquid crystal layer, and the pixels may be liquid crystal display pixels. Further, the liquid crystal layer may be vertical alignment (VA) mode liquid crystal. With this configuration, the voltage between both ends of the main capacitive element including the liquid crystal layer is increased than the original voltage value, enabling improvement of the response speed of the main capacitive element. Additionally, the additional potential is individually supplied, enabling the response speed to be controlled per liquid crystal display pixel. Preferably, the driving means individually changes the additional potential in each pixel where luminance level changes from black display state to white display state, so that the voltage between both ends of the main capacitive element rises higher than the original voltage. With this configuration, in the liquid crystal display pixel having the transition from black display state to white display state, for which it is particularly necessary to improve the response speed due to capacity changes of the VA mode liquid crystal at the time of applying a voltage, the voltage between both ends of the main capacitive element is set to a high value. This enables improvement of moving picture response characteristics per liquid crystal display pixel.

According to an embodiment of the present invention, there is provided a method of driving an image display device having a plurality of pixels, each of the pixels including a main capacitive element as a display element performing display operation in accordance with image data supplied to one end thereof, and an auxiliary capacitive element having one end connected to one end of the main capacitive element. The method includes a process of driving each of the pixels, the process including steps of: supplying the image date to the one end of the main capacitive element, which is commonly connected to the one end of the auxiliary capacitive element; supplying an additional potential to the other end of the auxiliary capacitive element in each of the pixels in synchronization with a timing of starting supply of the image data, the additional potential being individually determined so that a voltage between both ends of the main capacitive element rises higher than an original voltage; and resetting the other end of the auxiliary capacitive element to a predetermined reference potential after completion of supply of the image data.

In the method of driving the image display device of the embodiment of the present invention, at the time of the display driving of the pixels, the image data are supplied to one end of the main capacitive element and one end of the auxiliary capacitive element. Further, the additional potential is individually supplied to the other end of the auxiliary capacitive element in each of the pixels in synchronization with the timing of starting supply of the image data. The other end of the auxiliary capacitive element is then reset to a predetermined reference potential after completion of supply of the image data. With this method, the voltage between both ends of the main capacitive element is increased than the original voltage value. Unlike the related art where the batch power supply per scanning line is performed to the other end of the auxiliary capacitive element, the additional potential is individually supplied, enabling the adaptive power supply per auxiliary capacitive element, namely, per pixel.

Thus, in the image display device or the display panel of the embodiment of the present invention, at the time of the display driving of the pixels, the additional potential is supplied to the other end of the auxiliary capacitive element, and the additional potential is individually supplied. Therefore, in these pixels, the voltage between both ends of the main capacitive element may be increased than the original voltage value, and the adaptive power supply per pixel becomes possible. Hence, without causing deterioration of the display quality such as display variations between the pixels, a higher voltage than the original voltage may be applied to the pixels.

Thus, in the method of driving an image display device of the embodiment of the present invention, the image data are supplied to one end of the main capacitive element and one end of the auxiliary capacitive element, and the additional potential is individually supplied to the other end of the auxiliary capacitive element in synchronization with the timing of starting the supply of the image data. The other end of the auxiliary capacitive element is then reset to a predetermined reference potential after completion of supply of the image data. Therefore, in these pixels, the voltage between both ends of the main capacitive element may be increased than the original voltage value, and the adaptive power supply per pixel becomes possible. Hence, without causing deterioration of the display quality such as display variations between the pixels, a higher voltage than the original voltage can be applied to the pixels.

Other and further objects, features and advantages of the invention will appear more fully from the following description.

BRIEF DESCRIPTION OF THE DRAWINGS

FIG. 3 is a diagram for explaining a signal generation operation by an operation section shown in FIG. 1;

FIG. 4 is a diagram for explaining the voltage generation operation by an auxiliary capacitive voltage generation section shown in FIG. 1;

DESCRIPTION OF THE PREFERRED EMBODIMENTS

Preferred embodiments of the present invention will now be described in detail with reference to the accompanying drawings.

Figure 1:
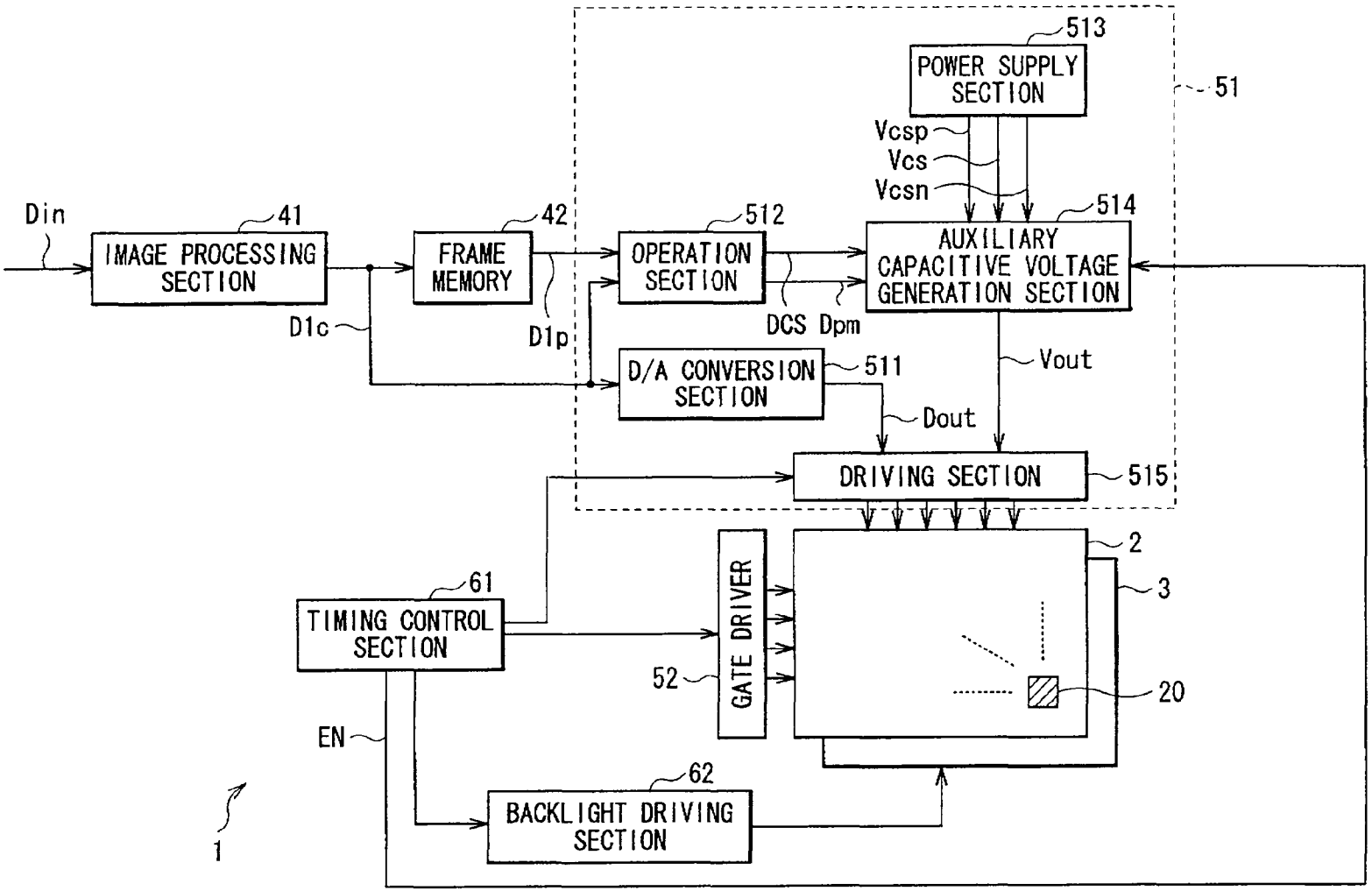
FIG. 1 is a block diagram showing the overall configuration of a liquid crystal display with a display panel according to an embodiment of the present invention.

FIG. 1 shows the overall configuration of an image display device (a liquid crystal display 1) provided with a display panel (a liquid crystal display panel 2 to be described later) according to an embodiment of the invention. The liquid crystal display 1 has the liquid crystal display panel 2, a backlight section 3, an image processing section 41, a frame memory 42, a source driver 51 and a gate driver 52, a timing control section 61, and backlight control section 62. The method of driving the image display device according to the present embodiment will be shown embodied in the liquid crystal display of the present embodiment.

The liquid crystal display panel 2 performs an image display based on an image signal Din by using a driving signal supplied from the source driver 51 and the gate driver 52 to be described later. The liquid crystal display panel 2 includes a plurality of pixels 20 arranged in a matrix. A pixel circuit unit (refer to FIG. 2) to be described later is formed in the respective pixels 20. The detailed configuration of the pixel circuit unit will be described later.

The backlight section 3 is a light source for applying light to the liquid crystal display panel 2, and includes, for example, a CCFL (cold cathode fluorescent lamp) and an LED (light emitting diode).

The image processing section 41 generates an image signal D1*c* as an RGB signal, by applying a predetermined image processing to an image signal Din (a luminance signal) from the outside.

The frame memory 42 stores in frame units the image signal D1*c* supplied per pixel from the image processing section 41.

The gate driver 52 drives line-sequentially the respective pixels 20 in the liquid crystal display panel 2, along scanning lines (not shown), in accordance with the timing control by the timing control section 61. The source driver 51 supplies a drive voltage based on the image signal D1*c* of the current frame and the image signal D1*p* of an immediately previous frame stored in the frame memory 42, to the pixels 20 in the liquid crystal display panel 2, respectively. The source driver 51 has a D/A (digital/analog) conversion section 511, an operation section 512, a power supply section 513, an auxiliary capacitive voltage generation section 514 and a driving section 515.

The D/A conversion section 511 outputs an image signal Dout as an analog signal to the driving section 515 by applying D/A conversion to the current frame image signal D1*c* to be supplied from the image processing section 41. For example, the D/A conversion section 511 is constructed of a resistor tree structure in which a plurality of resistors are connected in series.

The operation section 512 generates and outputs a 2-bit selection signal DCS by performing, for example, a predetermined operation defined in the table shown in FIG. 3, based on the current frame image signal D1*c* to be supplied from the image processing section 41, and the immediately previous frame image signal D1*p* stored in the frame memory 42. Based on the immediately previous frame image signal D1*p* stored in the frame memory 42, the operation section 512 also detects per pixel the polarity (the positive polarity or the negative polarity) of the signal in the image signal D1*p*, and outputs a polarity signal Dpm indicating the polarity of an individual pixel. The details of the signal generation operation by the operation section 512 will be described later.

The power supply section 513 includes a predetermined voltage circuit (not shown) for generating and outputting three reference voltages Vcs, Vcsp and Vcsn.

The auxiliary capacitive voltage generation section 514 generates, for example, seven kinds of auxiliary capacitive voltages shown in FIGS. 4 and 5 (voltages to be supplied onto the opposite electrode of an auxiliary capacitive element Cs to be described later), based on the reference voltages Vcs, Vcsp and Vcsn to be supplied from the power supply section 513. Further, based on the selection signal DSC and the polarity signal Dpm to be supplied from the operation section 512, the auxiliary capacitive voltage generation section 514 selects one voltage from these seven kinds of auxiliary capacitive voltages, and outputs it as an auxiliary capacitive voltage Vout to the driving section 515. In the voltage generation and output operation by the auxiliary capacitive voltage generation section 514, the valid (active state) and the invalid (inactive state) are to be switched by an enable signal EN to be supplied from the timing control section 61. The details of the voltage generation and output operation by the auxiliary capacitive voltage generation section 514 will be described later.

The driving section 515 drives the pixel circuit unit within the individual pixel 20 by selectively outputting either the image signal Dout indicating the image content based on the image signal Din to be supplied from the D/A conversion section 511, or the auxiliary capacitive voltage Vout to be supplied from the auxiliary capacitive voltage generation section 514 at a predetermined timing to be described later.

The timing control section (the timing generator) 61 controls the driving timings of the source driver 51, the gate driver 52 and the backlight driving section 62. The backlight driving section 62 controls the lighting operation of the backlight section 3, in accordance with the timing control by the timing control section 61.

Figure 2:
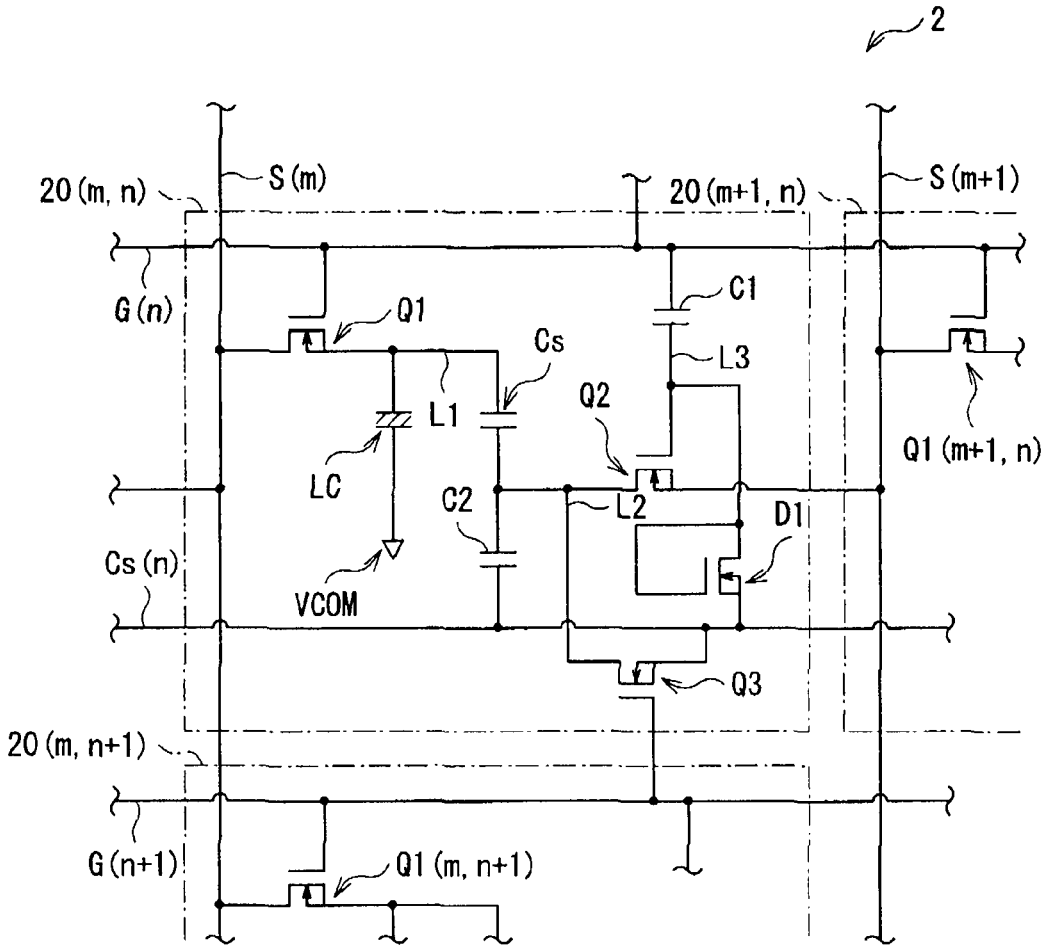
FIG. 2 is a circuit diagram showing the detailed configuration of a pixel circuit unit formed within an individual pixel shown in FIG. 1.

The configuration of the pixel circuit unit (the liquid crystal display pixel) formed in the individual pixels 20 will be described in detail with reference to FIG. 2. FIG. 2 shows an example of the circuit configuration of the pixel circuit unit in the pixel 20. The references "m" and "n" in FIG. 2 denote natural numbers, respectively, and the pixel 20 (m, n) denotes a pixel positioned at the coordinate (m, n) in a plurality of the pixels 20.

At the pixel 20 (m, n), a pixel circuit unit including a liquid crystal element LC as a main capacitive element, an auxiliary capacitive element Cs, a thin film transistor (TFT) element Q1, transistors Q2 and Q3 each functioning as a switching element, a transistor (diode) D1 functioning as a diode, and capacitive elements C1 and C2 is formed. A gate line G(n) for selecting line-sequentially pixel circuit units to be driven, a source line S(m) for supplying image data (the image signal Dout) to the pixel circuit unit to be driven, and an auxiliary capacitive line Cs(n) as a bus line for supplying a predetermined reference potential Vcs to the opposite electrode of an auxiliary capacitive element Cs to be described later are connected to the pixel 20 (m, n). A pixel 20 (m, n+1) adjacent to the pixel 20 (m, n) along the source line S(m) includes a TFT element Q1 (m, n+1). A gate line G(n+1), a source line S(m)

and an auxiliary capacitive line Cs(n+1) (not shown) are connected to the pixel 20 (m, n+1). A pixel 20 (m+1, n) adjacent to the pixel 20 (m, n) along the gate line G(n) includes a TFT element Q1 (m+1, n). A gate line G(n), a source line S(m+1) and an auxiliary capacitive line Cs(n) are connected to the pixel 20 (m+1, n).

The liquid crystal element LC functions as a display element performing the display operation (emitting a display light) based on the image signal Dout to be supplied from the source line S(m) via the TFT element Q1 to one end of the liquid crystal element LC. The liquid crystal element LC includes a liquid crystal layer (not shown) and a pair of electrodes having the liquid crystal layer in between. One (one end) of the pair of electrodes is connected via a connecting line L1 to the source of the TFT element Q1 and to one end of the auxiliary capacitive element Cs, and the other (the other end thereof) is connected to a common electrode VCOM. For example, the liquid crystal layer is composed of VA (vertical alignment) mode liquid crystal. Alternatively, it may be composed of TN (twisted nematic) mode liquid crystal.

The auxiliary capacitive element Cs is a capacitive element for stabilizing the accumulated electric charge of the liquid crystal element LC. One end (one electrode) of the auxiliary capacitive element Cs is connected via a connection line L1 to one end of the liquid crystal element LC and the source of the TFT element Q1, and the other end (the opposite electrode thereof) is connected via a connection line L2 to the drain of the transistor Q2, the drain of the transistor Q3 and one end of the capacitive element C2. The opposite electrode of the auxiliary capacitive element Cs is to be connected via the capacitive element C2 to the auxiliary capacitive line Cs(n).

The TFT element Q1 is composed of an MOS-FET (metal oxide semiconductor-field effect transistor). The gate of the TFT element Q1 is connected to the gate line G(n), the source thereof is connected via the connection line L1 to one end of the liquid crystal element LC and one end of the auxiliary capacitive element Cs, and the drain thereof is connected to the source line S(m). The TFT element Q1 functions as a switching element for supplying the image signal Dout to one end of the liquid crystal element LC and one end of the auxiliary capacitive element Cs. Specifically, it is designed to selectively make an electrical conduction between the source line S(m) and one end of the liquid crystal element LC, which is commonly connected to one end of the auxiliary capacitive element Cs within the pixel 20 (m, n), in accordance with a selection signal to be supplied from the gate driver 52 via the gate line G(n).

Similarly, the TFT element Q1 (m, n+1) is composed of an MOS-FET. The gate of the TFT element Q1 (m, n+1) is connected to the gate line G(n+1), the source thereof is connected to one end of the liquid crystal element LC and one end of the auxiliary capacitive element Cs within the pixel 20 (m, n+1), and the drain thereof is connected to the source line S(m). Thus, the TFT element Q1 (m, n+1) is adapted to selectively make an electrical conduction between the source line S(m) and one end of the liquid crystal element LC, which is commonly connected to one end of the auxiliary capacitive element Cs within the pixel 20 (m, n+1), in accordance with a selection signal to be supplied from the gate driver 52 via the gate line G(n+1). Similarly, the TFT element Q1 (m+1, n) is composed of an MOS-FET. The gate of the TFT element Q1 (m+1, n) is connected to the gate line G(n), the source thereof is connected to one end of the liquid crystal element LC and one end of the auxiliary capacitive element Cs within the pixel 20 (m+1, n), and the drain thereof is connected to the source line S(m+1). Thus, the TFT element Q1 (m+1, n) is adapted to selectively make an electrical conduction between the source line S(m+1) and one end of the liquid crystal element LC, which is commonly connected to one end of the auxiliary capacitive element Cs within the pixel 20 (m+1, n), in accordance with a selection signal to be supplied from the gate driver 52 via the gate line G(n).

The transistor Q2 is also composed of an MOS-FET. The gate of the transistor Q2 is connected via the connection line L3 to one end of the capacitive element C1, and the gate and drain of the transistor D1, the source thereof is connected to a source line S(m+1), and the drain thereof is connected via the connection line L2 to the opposite electrode of the auxiliary capacitive element Cs, one end of the capacitive element C2 and the drain of the transistor Q3. The transistor Q2 functions as a switching element for supplying the auxiliary capacitive voltage Vout (the additional potential) to the opposite electrode of the auxiliary capacitive element Cs in synchronization with the timing of supply of the image signal Dout by the TFT element Q1. Specifically, in accordance with a selection signal to be supplied from the gate driver 52 via the gate line G(n), it is designed to selectively make an electrical conduction between the source line (the adjacent source line) S(m+1) and the opposite electrode of the auxiliary capacitive element Cs within the pixel 20 (m, n), thereby temporarily supplying the auxiliary capacitive voltage Vout to the above opposite electrode.

The transistor Q3 is also composed of an MOS-FET. The gate of the transistor Q3 is connected to a game line (the adjacent gate line) G(n+1), the source thereof is connected to the auxiliary capacitive line Cs(n), and the drain thereof is connected via the connection line L2 to the opposite electrode of the auxiliary capacitive element Cs, one end of the capacitive element C2 and the drain of the transistor Q2. The transistor Q3 functions as a switching element for resetting the opposite electrode of the auxiliary element Cs to a predetermined reference potential Vcs, after completion of supply of the image signal Dout by the TFT element Q1. Specifically, in accordance with a selection signal to be supplied from the gate driver 52 via the gate line G(n+1), it is designed to selectively make an electrical conduction between the auxiliary capacitive line Cs(n) and the opposite electrode of the auxiliary capacitive element Cs, thereby supplying the reference potential Vcs to the above opposite electrode.

The transistor (the diode) D1 is also composed of an MOS-FET. The gate and drain thereof are connected via the connection line L3 to the gate of the transistor Q2 and one end of the capacitive element C1, respectively, and the source thereof is connected to the auxiliary capacitive line Cs(n). The transistor D1 functions as a discharge element (a diode for discharge) for causing the transistor Q2 to enter the off state, thereby making a selective disconnection between the source line S(m+1) and the opposite electrode of the auxiliary capacitive element Cs. The gate and the drain of the transistor D1 function as an anode, and the source thereof functions as a cathode. Instead of the diode D1, a resistance element may be used as the discharge element.

One end of the capacitive element C1 is connected via the connection line L3 to the gate of the transistor Q2 and the gate and drain of the transistor D1, and the other end is connected to the gate line G(n). The capacitive element C1 is adapted to supply a selection signal in a pulse form to the gate of the transistor Q2, by accumulating, as electric charge, the selection signal to be supplied from the gate line G(n).

One end of the capacitive element C2 is connected via the connection line L2 to the opposite electrode of the auxiliary capacitive element Cs, the drain of the transistor Q2 and the drain of the transistor Q3, and the other end thereof is connected to the auxiliary capacitive line Cs(n). The capacitive element C2 is a capacitive element for holding the potential at the opposite electrode of the auxiliary capacitive element Cs, thereby stabilizing the voltage between both ends of the auxiliary capacitive element Cs.

Here, the above pixel circuit unit corresponds to a specific example of the "pixel" and the "liquid crystal display pixel" in the invention, and the source driver 51 and the gate driver 52 correspond to a specific example of the "driving means" in the invention. The liquid crystal element LC corresponds to a specific example of the "main capacitive element" and the "display element" in the invention. The switching element Q1 corresponds to a specific example of "a first switching element" in the invention. The switching element Q2 corresponds to a specific example of "a second switching element" in the invention. The switching element Q3 corresponds to a specific example of "a third switching element" in the invention. The capacitive element C1 corresponds to "a first capacitive element," and the capacitive element C2 corresponds to "a second capacitive element." The gate line G(n) corresponds to a specific example of "a gate line," the gate line G(n+1) corresponds to a specific example of "an adjacent gate line," the source line S(m) corresponds to a specific example of "a source line" in the invention, the source line S(m+1) corresponds to a specific example of "an adjacent source line" in the invention, and the auxiliary capacitive line Cs(n) corresponds to a specific example of "a reference potential line" in the invention.

The operation of the liquid crystal display 1 of the present embodiment having the above configuration will be described in detail.

Firstly, the overall operation of the liquid crystal display 1 will be described with reference to FIG. 1 and FIGS. 3 to 5.

In the liquid crystal display 1, as shown in FIG. 1, the image signal Din supplied from the outside is processed by the image processing section 4, thereby generating the image signal D1*c* for the individual pixel 20 in the liquid crystal display panel 2. The generated image signal D1*c* is directly supplied to the source driver 51 as the current frame image signal D1*c*, and also stored in a frame at the frame memory 42, and then supplied to the source driver 51 as the immediately previous frame mage signal D1*p*. By a driving voltage (a pixel applying voltage) to the respective pixels 20 to be outputted based on these image signals 1*c* and D1*p* from the gate driver 52 and the source driver 51, a line-sequential display driving operation is performed with respect to the respective pixels 20, and the illuminating light from the backlight section 3 is modulated by the liquid crystal display panel 2 so as to be outputted as a display light from the liquid crystal display panel 2. Thus, the image display is performed by using the display light based on the image signal Din.

In the source driver 51, the D/A conversion is applied to the current frame image signal D1*c* by the D/A conversion section 511, so that the image signal Dout is outputted as an analog signal to the driving section 515.

On the other hand, in the operation section 512, a 2-bit selection signal DCS is generated by performing, for example, a predetermined operation defined in the table shown in FIG. 3, based on the current frame image signal D1*c* to be supplied from the image processing section 41, and the immediately previous frame image signal D1*p* stored in the frame memory 42. Specifically, selection signals DCS "01", "10" and "11" are selectively allocated to pixel circuit units (liquid crystal display pixels) having at least a predetermined threshold value in luminance level difference between the current frame image signal D1*c* and the immediately previous image signal D1*p*. A selection signal DCS "00" is selectively allocated to liquid crystal display pixels having a luminance level difference below the threshold value. More specifically, in the case where the liquid crystal is VA mode liquid crystal, as shown in FIG. 3, selection signals DCS "01", "10" and "11" are selectively allocated to liquid crystal display pixels causing a transition from black display state (for example, the display state in the vicinity of a luminance level 0/63 IRE) to white display state (for example, the display state in the vicinity of a luminance level 63/63 IRE), that is, liquid crystal display pixels having at least a predetermined threshold value in the luminance level difference between white display state and black display state. Further, the selection signal DCS "01" is changed to DCS "10" or "11" with increasing the luminance level difference.

Also in the operation section 512, based on the immediately previous image signal D1*p* stored in the frame memory 42, the polarity (the positive polarity "+" or the negative polarity "−") of signals in the image signal D1*p* is detected per pixel, thereby outputting a polarity signal Dpm indicating the polarity per pixel.

Figure 5:
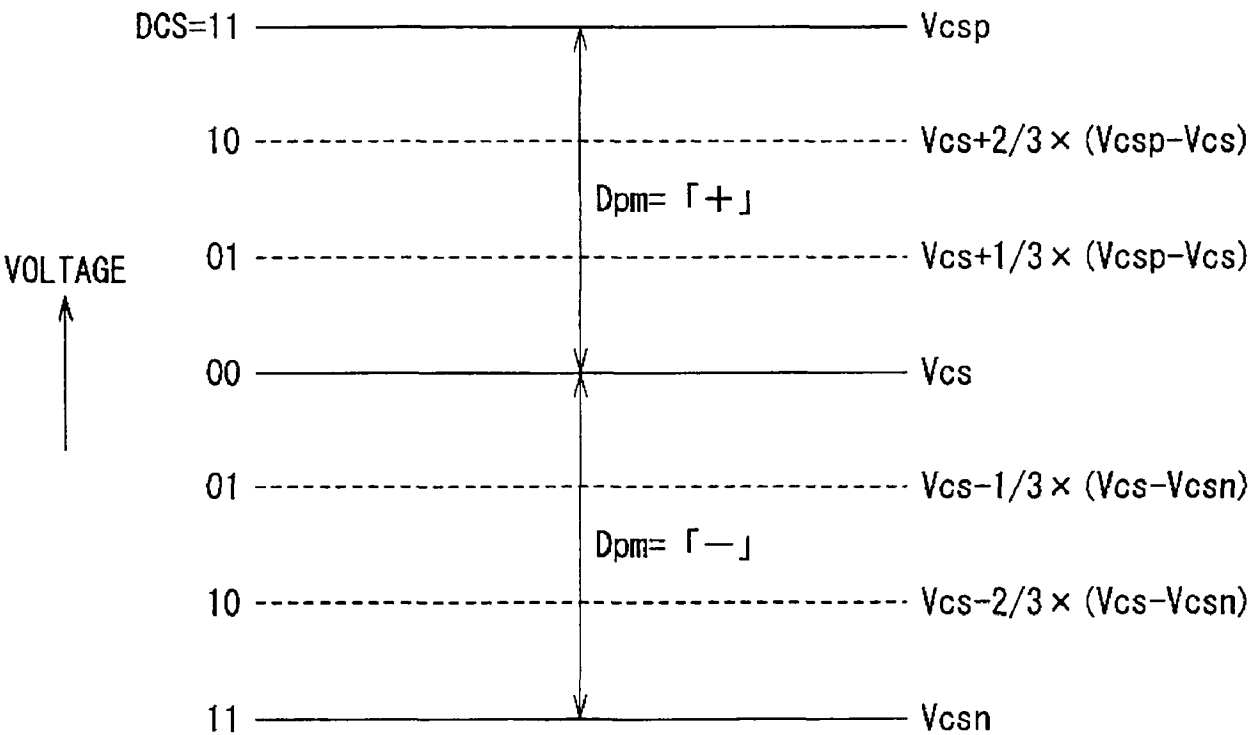
FIG. 5 is a diagram for explaining the details of the voltage generation operation shown in FIG. 4.

On the other hand, in the auxiliary capacitive voltage generation section 514, for example, seven kinds of auxiliary capacitive voltages shown in FIGS. 4 and 5 are generated based on the reference voltages Vcs, Vcsp and Vcsn to be supplied from the power supply section 513. Further, based on the selection signal DCS and the polarity signal Dpm to be supplied from the operation section 512, one voltage is selected from these seven kinds of auxiliary capacitive voltages, and the selected voltage is outputted as an auxiliary capacitive voltage Vout to the driving section 515. Specifically, if the polarity signal Dpm is the positive polarity (when Dpm is "+"), the positive polarity auxiliary capacitive voltage Vout is selected, and if the polarity signal Dpm is the negative polarity (when Dpm is "−"), the negative polarity auxiliary capacitive voltage Vout is selected. Owing to dot inversion driving operation, in the pixel circuit unit within a certain pixel 20, an auxiliary capacitive voltage Vout having the different polarity from the image data Dout (the voltage between both ends of the liquid crystal element LC) is supplied to the opposite electrode of the auxiliary capacitive element Cs, thereby increasing the voltage between both ends of the liquid crystal element LC than the original voltage value based on the image data Dout. With respect to the pixel circuit units having the selection signals DCS "01," "10" and "11" (the pixel circuit units having at least the predetermined threshold value in the luminance level difference between white display state and black display state), the auxiliary capacitive voltage Vout is selectively selected to be greater than the reference voltage Vcs. With respect to the pixel circuit units having the selection signal DCS "00," selection is made so that the auxiliary capacitive voltage Vout becomes the reference voltage Vcs. Further, in response to the change of the selection signal DCS, from "01" to "10" or "11" (with increasing the luminance level difference between white display state and black display state), selection is made so that the absolute value of the auxiliary capacitive voltage Vout is selectively increased.

In the driving section 515, either the image signal Dout indicating the image content based on the image signal Din to be supplied from the D/A conversion section 511, or the auxiliary capacitive voltage Vout to be supplied from the auxiliary capacitive voltage generation section 514 is selectively outputted at a predetermined timing to be described later, so that the pixel circuit units within the respective pixels 20 is driven line-sequentially and by dot inversion.

Figure 6:
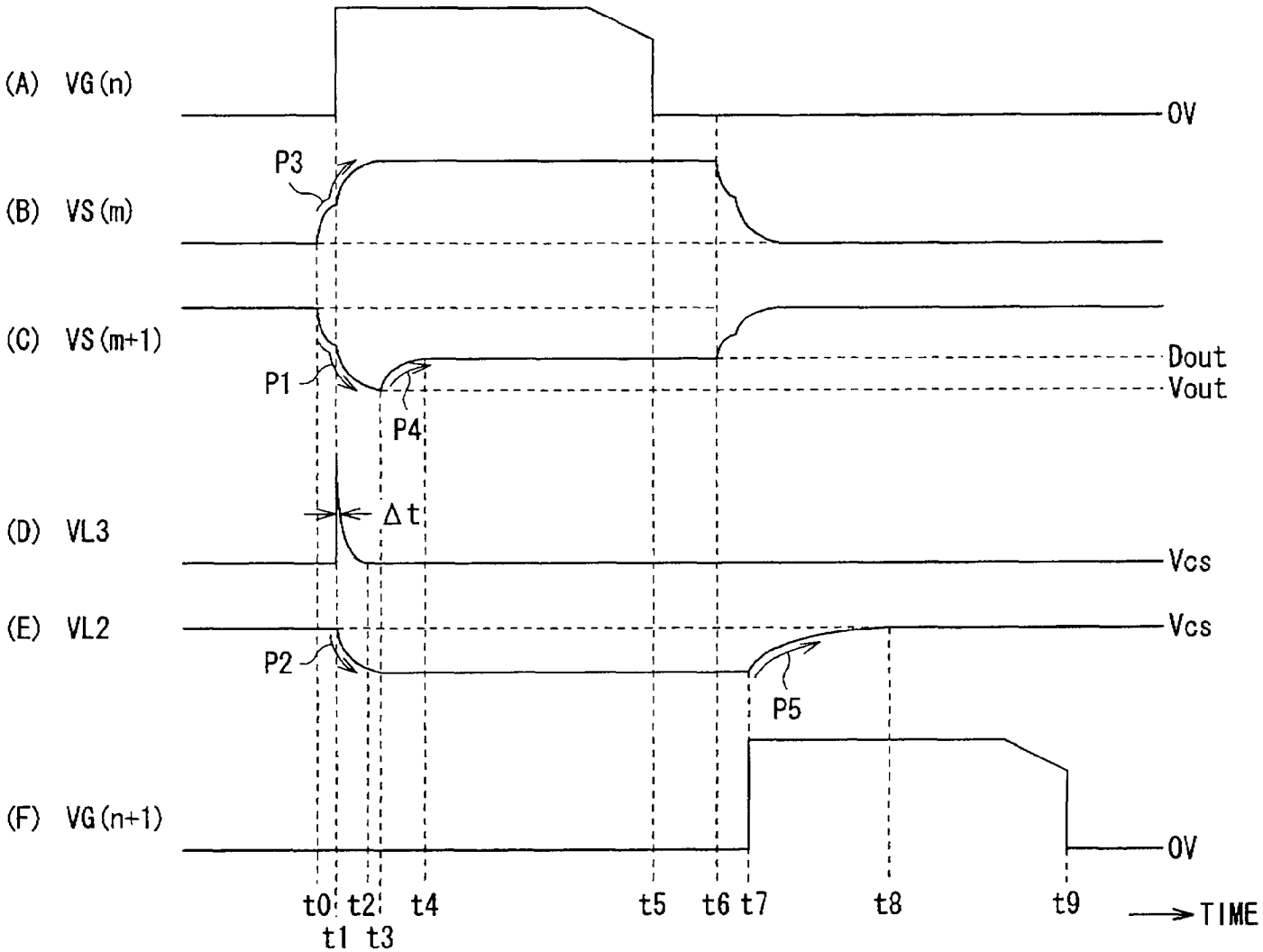
FIG. 6 is a timing waveform diagram showing the driving operation of the pixel circuit unit shown in FIG. 2.

Next, the driving operation of the image display device 1 of the present embodiment will be described in detail with reference to FIG. 2 and FIG. 6 to FIG. 11, in addition to FIG. 1 and FIGS. 3 to 5. FIG. 6 shows the driving operation of the pixel circuit unit of the embodiment by a timing waveform diagram. That is, (A) and (F) in FIG. 6 show the potentials VG(n) and VG(n+1) of the gate lines G(n) and G(n+1) (the selection signals to be supplied from the gate driver 52), respectively. (B) and (C) in FIG. 6 show the potentials VS(m) and VS(m+1) of the source lines S(m) and S(m+1) (the image signals Dout to be supplied from the source driver 51), respectively. (D) in FIG. 6 shows the potential VL3 of the connection line L3, and (E) in FIG. 6 shows the potential VL2 of the connection line L2. FIGS. 7 to 11 are phase diagrams for explaining the driving operation of the pixel circuit unit shown in FIG. 6, in which, for the sake of convenience, the TFT element Q1 and the transistors Q2 and Q3 are represented by a switch, and the transistor D1 is represented by a diode.

In the pixel circuit unit within the pixel 20 (n, m) shown in FIG. 2, for example, a so-called dot inversion driving operation is performed as shown in FIG. 6. Specifically, in a timing t0, the image signal Dout for the pixel 20 (m, n) is supplied from the driving section 515 via the source line S(m) ((B) in FIG. 6), and the auxiliary capacitive voltage Vout for the pixel 20 (m, n) is supplied from the driving section 515 via the source line S(m+1) ((C) in FIG. 6).

Figure 7:
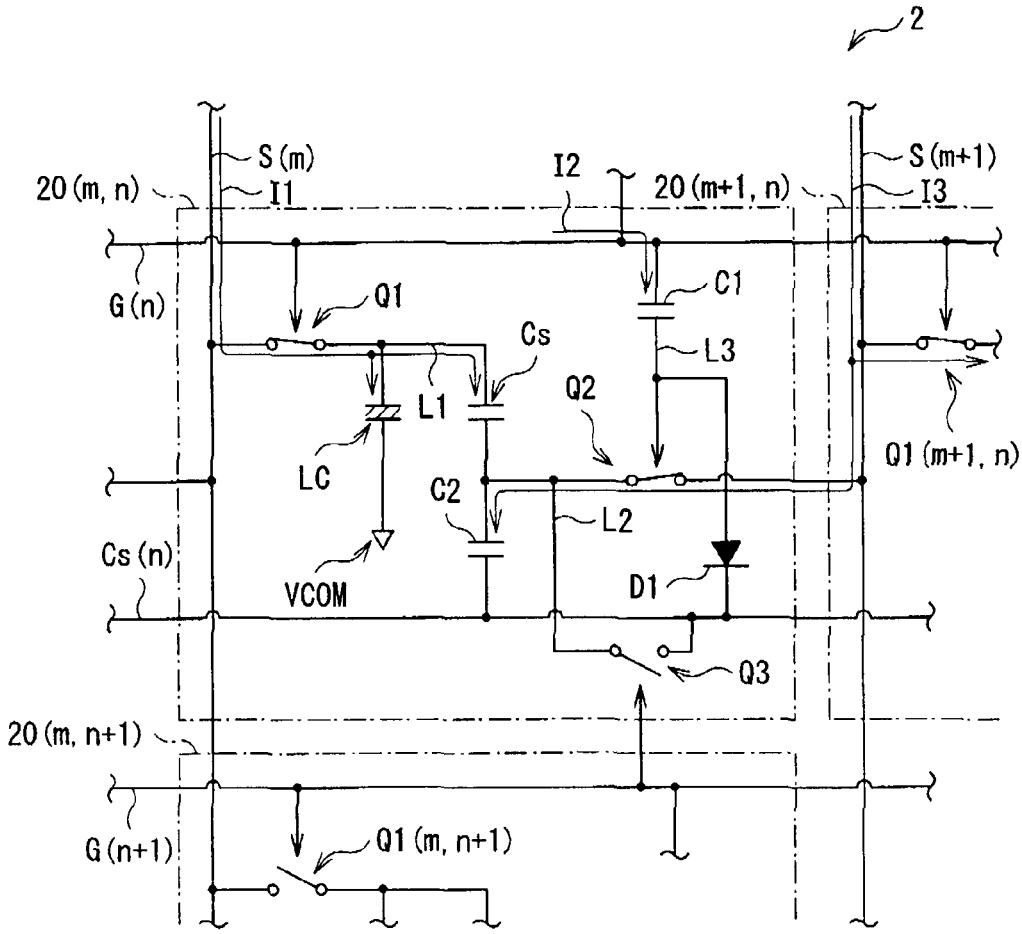
FIG. 7 is a phase diagram for explaining the driving operation of the pixel circuit unit shown in FIG. 2.

In a timing t1, the selection signal for the pixel 20 (m, n) is supplied from the gate driver 52 via the gate line G(n), and a potential in pulse form occurs on the gate line G(n) ((A) in FIG. 6). Thus, the TFT elements Q1 and Q1 (m+1, n) enter the on state. For example, as shown in FIG. 7, a current I based on the image signal Dout flows, and electric charge is accumulated at one end of the liquid crystal element LC and one end of the auxiliary capacitive element Cs (image data are supplied thereto). At this time, as shown in FIG. 7, a current I2 is also supplied via the gate line G(n) to the capacitive element C1. Thus, the potential VL3 of the connection line L3 also occurs in a pulse form ((D) in FIG. 6). Therefore, the transistor Q2 also enters the on state, and as shown in FIG. 7, a current I3 based on the auxiliary capacitive voltage Vout from the driving section 515 via the source line S(m+1) is accumulated at the capacitive element C2. Thus, as shown by the arrow P2 in FIG. 6, the potential of the different polarity (the negative polarity) from the voltage between both ends of the liquid crystal element LC (the voltage VS(m) of the source line S(m)) is supplied to the opposite electrode of the auxiliary capacitive element Cs. As a result, as shown by the arrow P3 in FIG. 6, the voltage between both ends of the liquid crystal element LC (the voltage VS(m) of the source line S(m)) is increased than the original voltage value based on the image signal Dout, thereby increasing the response speed of the liquid crystal LC.

Figure 8:
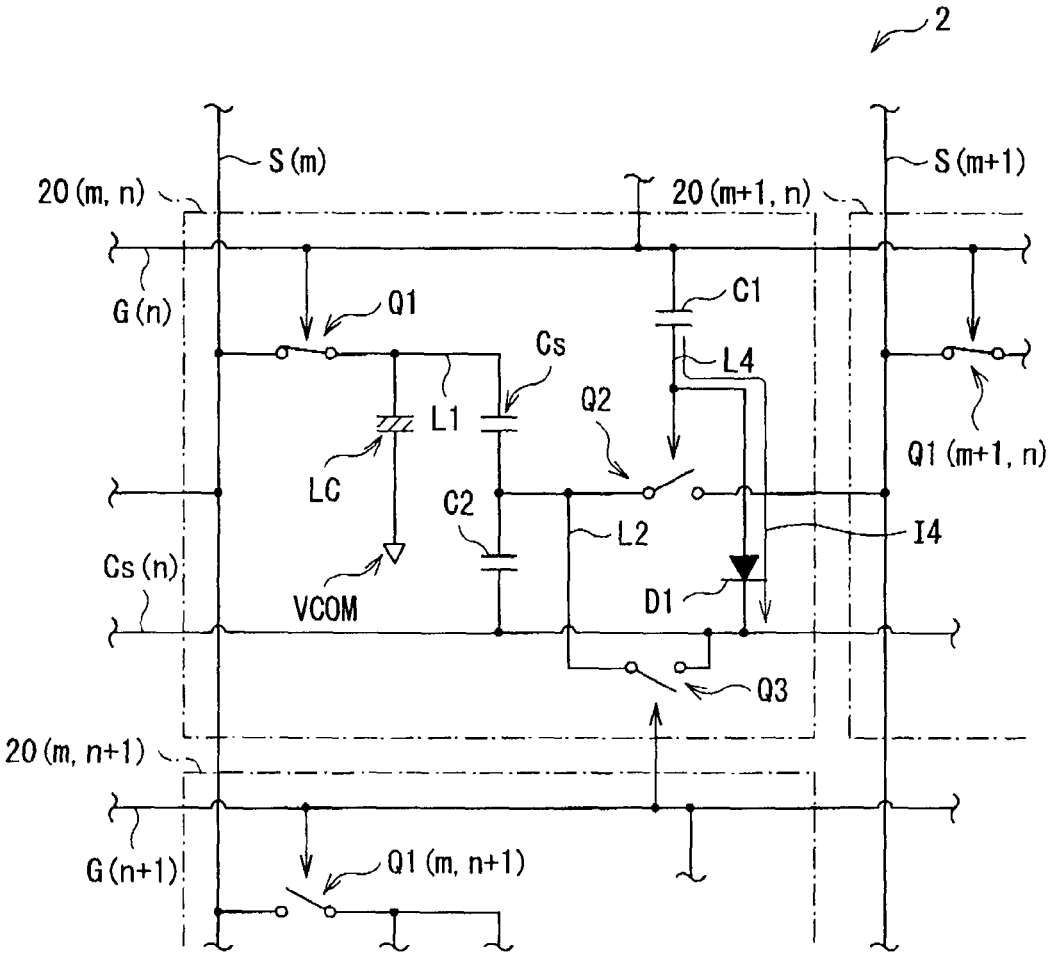
FIG. 8 is a phase diagram for explaining the driving operation of the pixel circuit unit to be continued from FIG. 7.

Subsequently, as shown by a current I4 in FIG. 8, the electric charge amount accumulated at the capacitive element C1 is increased, so that the diode D1 is electrically conducted and the accumulated electric charge at the capacitive element C1 is discharged. Thus, the potential VL3 of the connection line L3 returns to the initial value by a half width Δt (=approximately 1 to 2 μs) ((D) in FIG. 6). Consequently, as shown in FIG. 8, the transistor Q2 enters the off state, terminating the supply of the auxiliary capacitive voltage Vout to the opposite electrode of the auxiliary capacitive element Cs.

Figure 9:
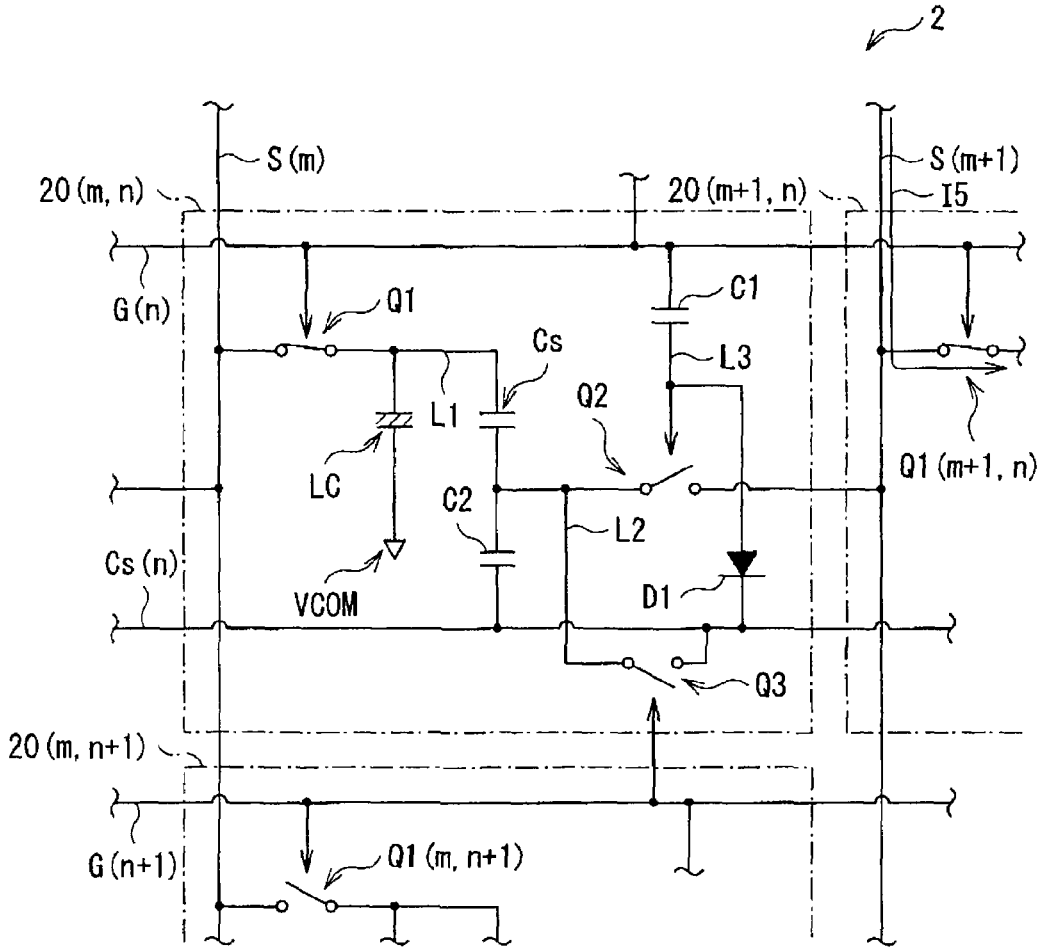
FIG. 9 is a phase diagram for explaining the driving operation of the pixel circuit unit to be continued from FIG. 8.

In a timing t3, for example, as shown by a current I5 in FIG. 9, the proper image signal Dout is supplied from the driving section 515 via the source line S(m+1) to the adjacent pixel 20 (n, m+1) ((C) in FIG. 6). Thus, as shown by the arrow P4 in FIG. 6, in a timing t4, the original voltage based on the image signal Dout is applied to the liquid crystal element LC within the pixel 20 (n, m+1) ((C) in FIG. 6).

Figure 10:
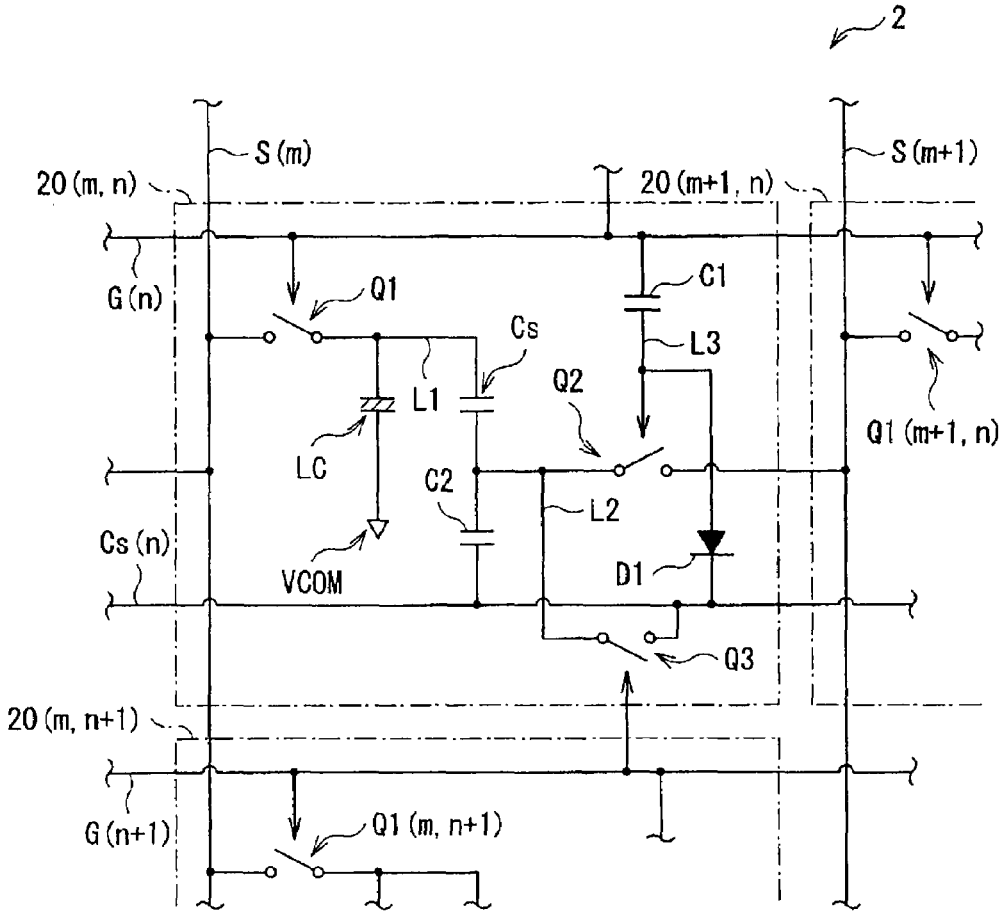
FIG. 10 is a phase diagram for explaining the driving operation of the pixel circuit unit to be continued from FIG. 9.
Figure 11:
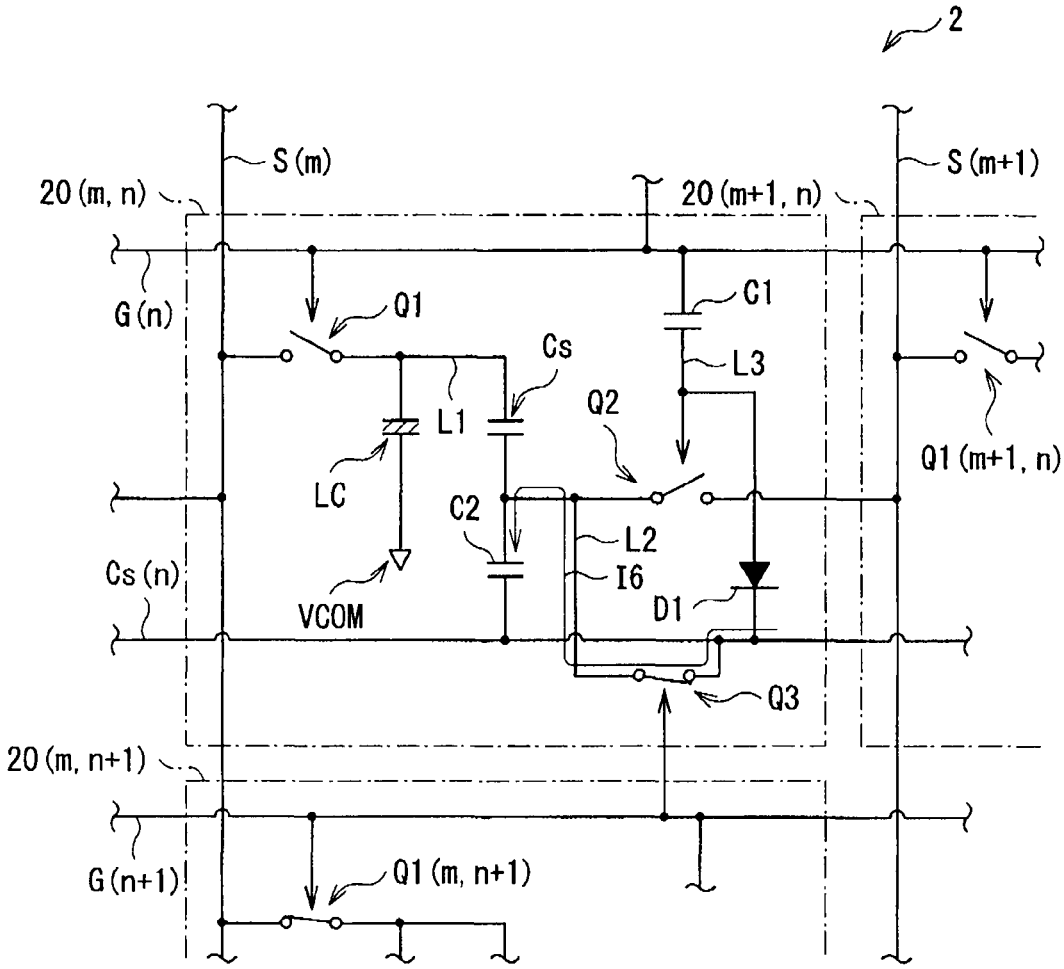
FIG. 11 is a phase diagram for explaining the driving operation of the pixel circuit unit to be continued from FIG. 10.

In a timing t5, the supply of a selection signal for the pixel 20 (m, n) from the gate driver 52 via the gate line G(n) is terminated, and the potential VG(n) of the gate line G(n) returns to the initial value ((A) in FIG. 6). Thus, as shown in FIG. 10, the TFT elements Q1 and Q" enter the off state.

In a timing t7, a selection signal for the pixel 20 (m, n+1) is supplied from the gate driver 52 via the gate line G(n+1), and a potential in a pulse form occurs on the gate line G(n+1) ((F) in FIG. 6). Thus, the TFT element Q1 (m, n+1) enters the on state. For example, as shown by a current I6 in FIG. 11, current flows to the capacitive element C2. Therefore, as shown by the arrow P5 in FIG. 6, the potential of the connection line L2 (the potential of the opposite electrode of the auxiliary capacitive element Cs) is reset (returned) to the reference potential Vcs of the auxiliary capacitive line Cs(n) until a timing t8. Thereafter, in a timing t9, the supply of the selection signal for the pixel 20 (m, n+1) from the gate driver 52 via the gate line G(n+1) is terminated, and the potential VG(n+1) of the gate line G(n+1) returns to the initial value ((F) in FIG. 6).

Thus in the present embodiment, at the time of the display driving of the respective pixel circuit units (the liquid crystal display pixels) within the liquid crystal display panel 2, the auxiliary capacitive voltage Vout to be generated by the auxiliary capacitive voltage generation section 514 is supplied to the other end (the opposite electrode) of the auxiliary capacitive element Cs within the pixel 20, and the auxiliary capacitive voltage Vout is supplied per auxiliary capacitive element Cs. With this configuration, in each pixel, the voltage between both ends of the liquid crystal element LC may be increased than the original voltage value based on the image signal Dout, and it becomes possible to supply the adaptive power per liquid crystal display pixel. Hence, without causing deterioration of the display quality such as display variations between the liquid crystal display pixels, a higher voltage than the original voltage may be applied to the liquid crystal display pixels, enabling improvement of the response speed of the liquid crystal element LC.

Specifically, during the display driving of the respective liquid crystal display pixels, the image signal Dout is supplied to one of the liquid crystal element LC and one end of the auxiliary capacitive element Cs, and in synchronization with the start of the supply of the image signal Dout, the auxiliary capacitive voltage Vout is supplied per auxiliary capacitive element Cs to the opposite electrode of the auxiliary capacitive element Cs. After completion of supply of the image signal Dout, the opposite electrode of the auxiliary capacitive element Cs is reset to the reference voltage Vcs. This configuration provides the abovementioned effect.

As the auxiliary capacitive voltage Vout, the potential of the different polarity potential from the voltage between both ends of the liquid crystal element LC is supplied per auxiliary capacity element Cs. Hence, the different polarity potential from the voltage between both ends of the liquid crystal element LC is supplied to the opposite electrode of the auxiliary capacitive element Cs, so that the voltage between both ends of the liquid crystal element LC becomes higher than the original voltage value.

In accordance with the image signal Dout to be supplied to the individual liquid crystal display pixel, the auxiliary capacitive voltage Vout is changed per auxiliary capacitive element Cs. Therefore, depending on the image signal Dout, the abovementioned auxiliary capacitive voltage Vout may be supplied to the opposite electrode of the auxiliary capacitive element Cs in the individual liquid crystal display pixel. Hence, the adaptive power supply per liquid crystal display pixel becomes possible depending on the display image.

The absolute value of the auxiliary capacitive voltage Vout is increased with increasing the luminance level difference of the image signal between the current unit frame and the immediately previous unit frame. Therefore, a further adaptive power supply becomes possible depending on the image signal Dout.

The liquid crystal element LC includes the vertical alignment (VA) mode liquid crystal, and the auxiliary capacitive voltage Vout is changed per auxiliary capacitive element Cs so that the voltage between both ends of the liquid crystal element LC is selectively increased with respect to the liquid crystal display pixels having a transition from black display state to white display state. Therefore, in the liquid crystal display pixels having the transition from black display state to white display state, for which it is particularly necessary to improve the response speed due to capacity changes of the VA mode liquid crystal at the time of applying a voltage, the voltage between both ends of the liquid crystal element LC can be selectively set to a high value. This enables selective improvement of moving picture response characteristics per liquid crystal display device.

The source line S(m+1) and the gate line G(n+1) of the adjacent pixel are shared time-divisionally to supply the auxiliary capacitive voltage Vout. Therefore, the area of wiring can be reduced, and the aperture ratio of the pixel 20 can be increased than the following first to fourth modifications. Compared with the pixel circuit unit of the related art, the transistors Q2 and Q3, the diode D1, the capacitive elements C1 and C2 are added, each of which has, for example, a low driving capability and has a small size. Hence, the addition of these elements hardly adversely affects on the area of the pixel circuit unit in comparison with that in the related art.

The several modifications of the present embodiment will be described below. In these modifications, those parts corresponding to the components in the present embodiment are identified with the same numerals, and the description thereof is omitted.

First Modification

Figure 12:
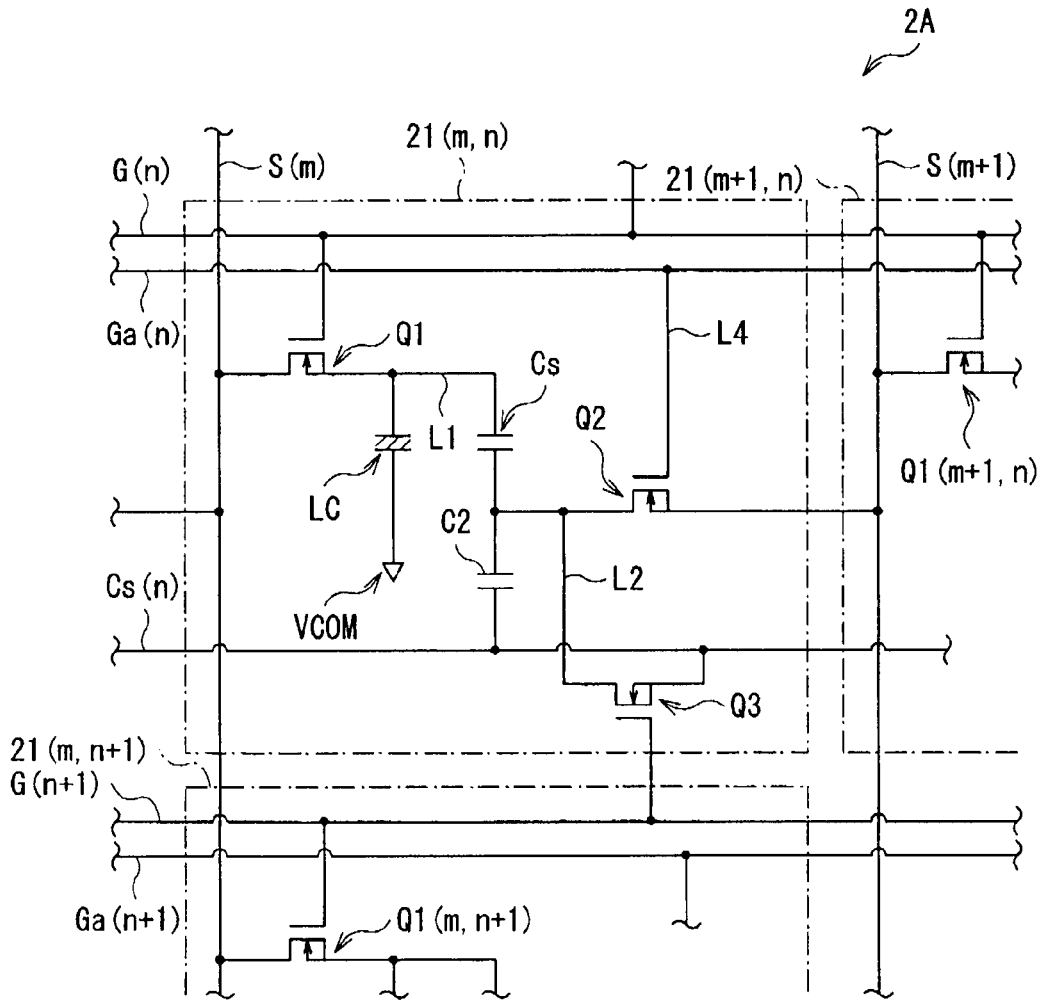
FIG. 12 is a circuit diagram showing the detailed configuration of a pixel circuit unit according to a first modification.
Figure 13:
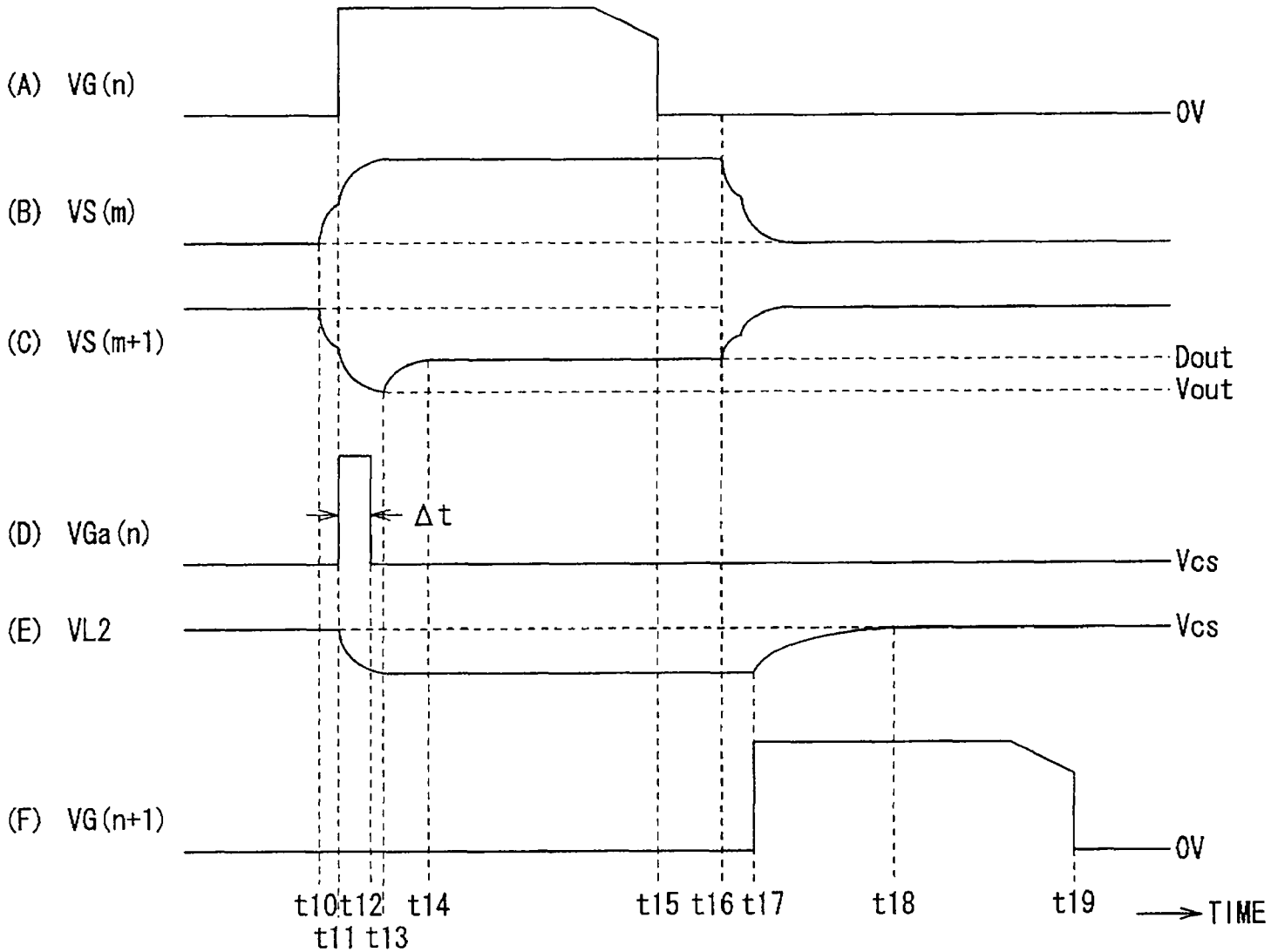
FIG. 13 is a timing waveform diagram showing the driving operation of the pixel circuit unit shown in FIG. 12.

FIG. 12 shows the circuit configuration of a pixel circuit unit formed in an individual pixel 21 of a display panel (a liquid crystal display panel 2A) according to a first modification. FIG. 13 shows the driving operation of the pixel circuit unit according to the first modification by a timing waveform diagram (timings t10 to t19).

The pixel circuit unit within the pixel 21 (m, n) in the first modification is similar to the pixel 20 (m, n) in the foregoing embodiment, except that the gate line is composed of two gate lines, namely a gate line (the main gate line) G(n) and an auxiliary gate line Ga(n), and therefore neither the capacitive element C1 nor the diode D1 is disposed.

Specifically, the gate of a transistor Q2 of the first modification is connected via a connection line L4 to the auxiliary gate line Ga(n), the source thereof is connected to a source line S(m+1), and the drain thereof is connected via a connection line L2 to the opposite electrode of an auxiliary capacitive element Cs, one end of a capacitive element C2 and the drain of a transistor Q3. In accordance with a selection signal supplied from a gate driver 52 via the gate line Ga(n), the transistor Q2 functions as a switching element for temporarily supplying an auxiliary capacitive voltage Vout (the additional potential) to the opposite electrode of the auxiliary capacitive element Cs.

In the first modification having the above configuration, as shown in (D) in FIG. 13, in accordance with the selection signal supplied from the gate driver 52 via the gate line G(n) in timings t11 to t12 (the half width in the period, Δt), a selective electrical conduction is made between the source line S(m+1) and the opposite electrode of the auxiliary capacitive element Cs within the pixel 21 (m, n), so that the auxiliary capacitive voltage Vout is temporarily supplied to the opposite electrode of the auxiliary capacitive element Cs. Consequently, the same effect may be obtained by the same operation as the foregoing embodiment. That is, without causing deterioration of the display quality such as display variations between the liquid crystal display pixels, a higher voltage than the original voltage may be applied to the liquid crystal display pixels, enabling improvement of the response speed of the liquid crystal element LC.

Additionally, it is not necessary to provide the capacitive element C1 and the diode D1 in the first modification; therefore, the pixel circuit unit configuration is simplified, and the area thereof is reduced than the foregoing embodiment.

Second Modification

Figure 14:
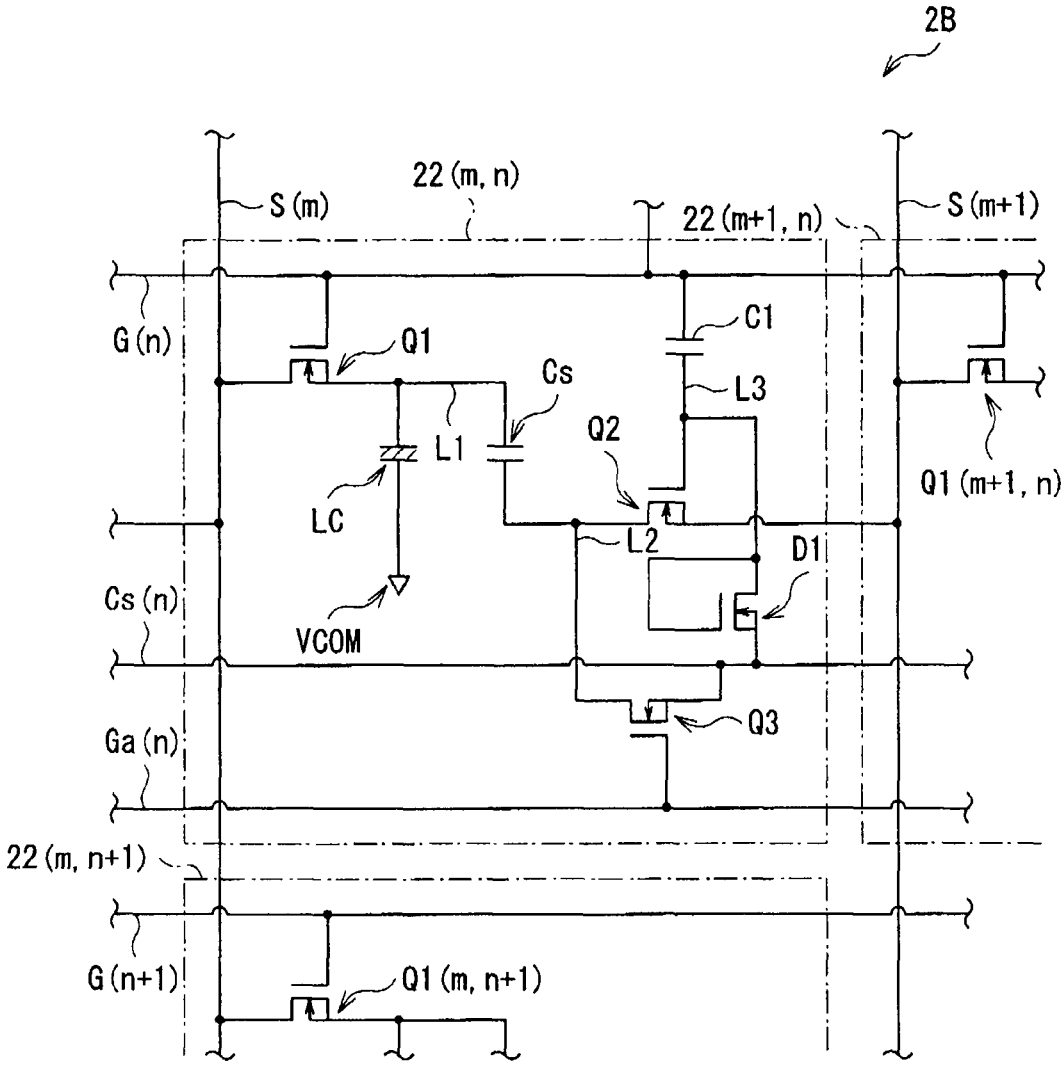
FIG. 14 is a circuit diagram showing the detailed configuration of a pixel circuit unit according to a second modification.
Figure 15:
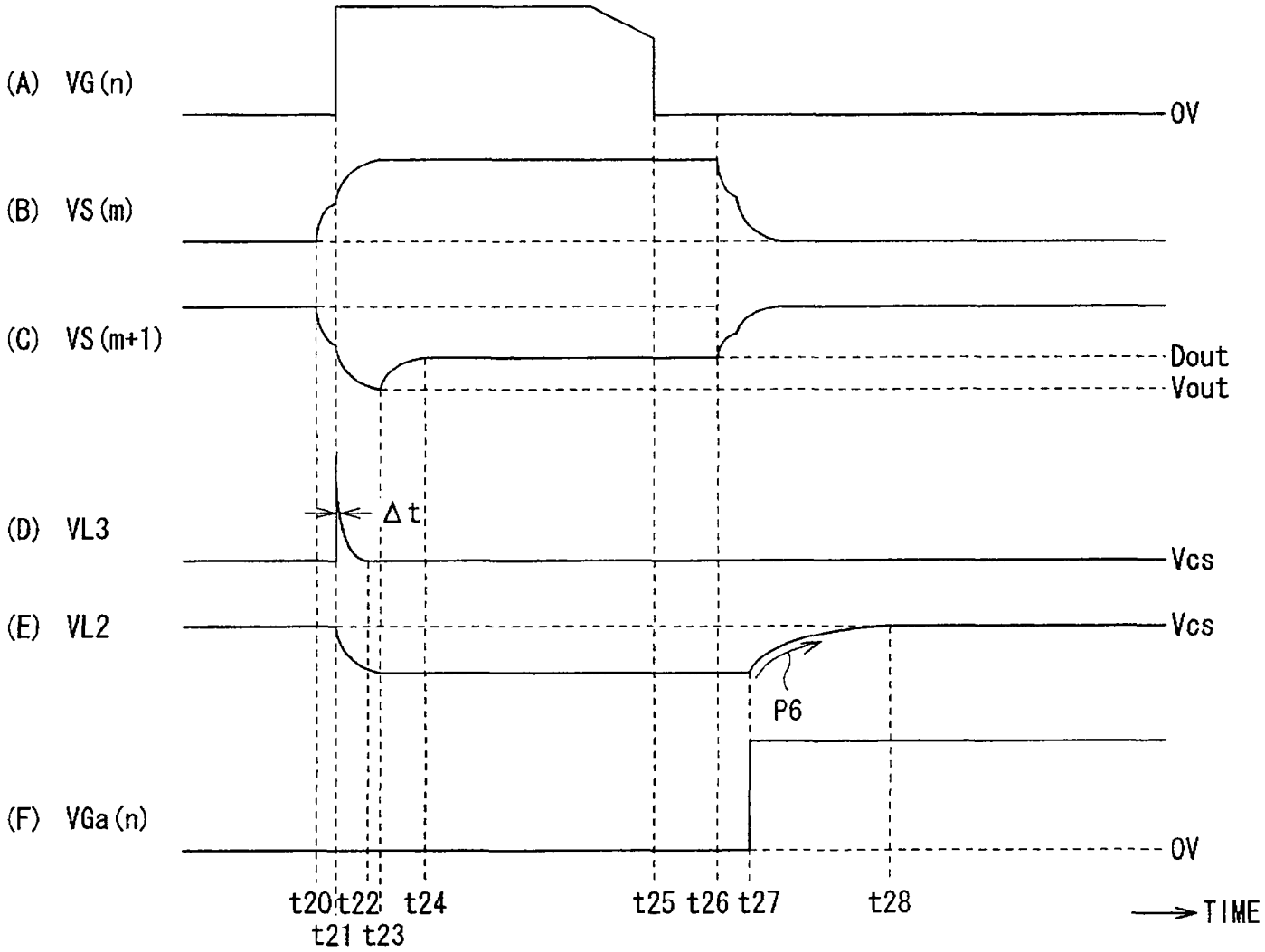
FIG. 15 is a timing waveform diagram showing the driving operation of the pixel circuit unit shown in FIG. 14.

FIG. 14 shows the circuit configuration of a pixel circuit unit formed in an individual pixel 22 of a display panel (a liquid crystal display panel 2B) according to a second modification. FIG. 15 shows the driving operation of the pixel circuit unit according to the second modification by a timing waveform diagram (timings t20 to t28).

The pixel circuit unit within the pixel 22 (m, n) in the second modification is similar to the pixel 20 (m, n) in the foregoing embodiment, except that the gate line is composed of two gate lines, namely a gate line (the main gate line) G(n) and an auxiliary gate line Ga(n), and therefore, the capacitive element C2 is not disposed.

Specifically, the gate of a transistor Q3 of the second modification is connected to the auxiliary gate line Ga(n), the source thereof is connected to an auxiliary capacitive line Cs(n), and the drain thereof is connected via a connection line L2 to the opposite electrode of an auxiliary capacitive element Cs and the drain of a transistor Q2. In accordance with a selection signal supplied from a gate driver 52 via the auxiliary gate line Ga(n), the transistor Q3 functions as a switching element for resetting the opposite electrode of the auxiliary capacitive element Cs to a predetermined reference potential Vcs, after an image signal Dout is supplied from the TFT element Q1.

In the second modification having the above configuration, as shown in (F) in FIG. 15, in accordance with the selection signal supplied from the gate driver 52 via the gate line Ga(n) in timings t27 to t28, a selective electrical conduction is made between the auxiliary capacitive line Cs(n) and the opposite electrode of the auxiliary capacitive element Cs, so that, as shown by the arrow P6 in FIG. 15, the reference potential Vcs is supplied and reset to the opposite electrode of the auxiliary capacitive element Cs. Consequently, the same effect is obtained by the same operation as the foregoing embodiment. That is, without causing deterioration of the display quality such as display variations between the liquid crystal display pixels, a higher voltage than the original voltage may be applied to the liquid crystal display pixels, enabling improvement of the response speed of the liquid crystal element LC.

Additionally, it is not necessary to provide the capacitive element C2 in the second modification; therefore, the pixel circuit unit configuration is simplified, and the area thereof is reduced than the foregoing embodiment.

Third Modification

Figure 16:
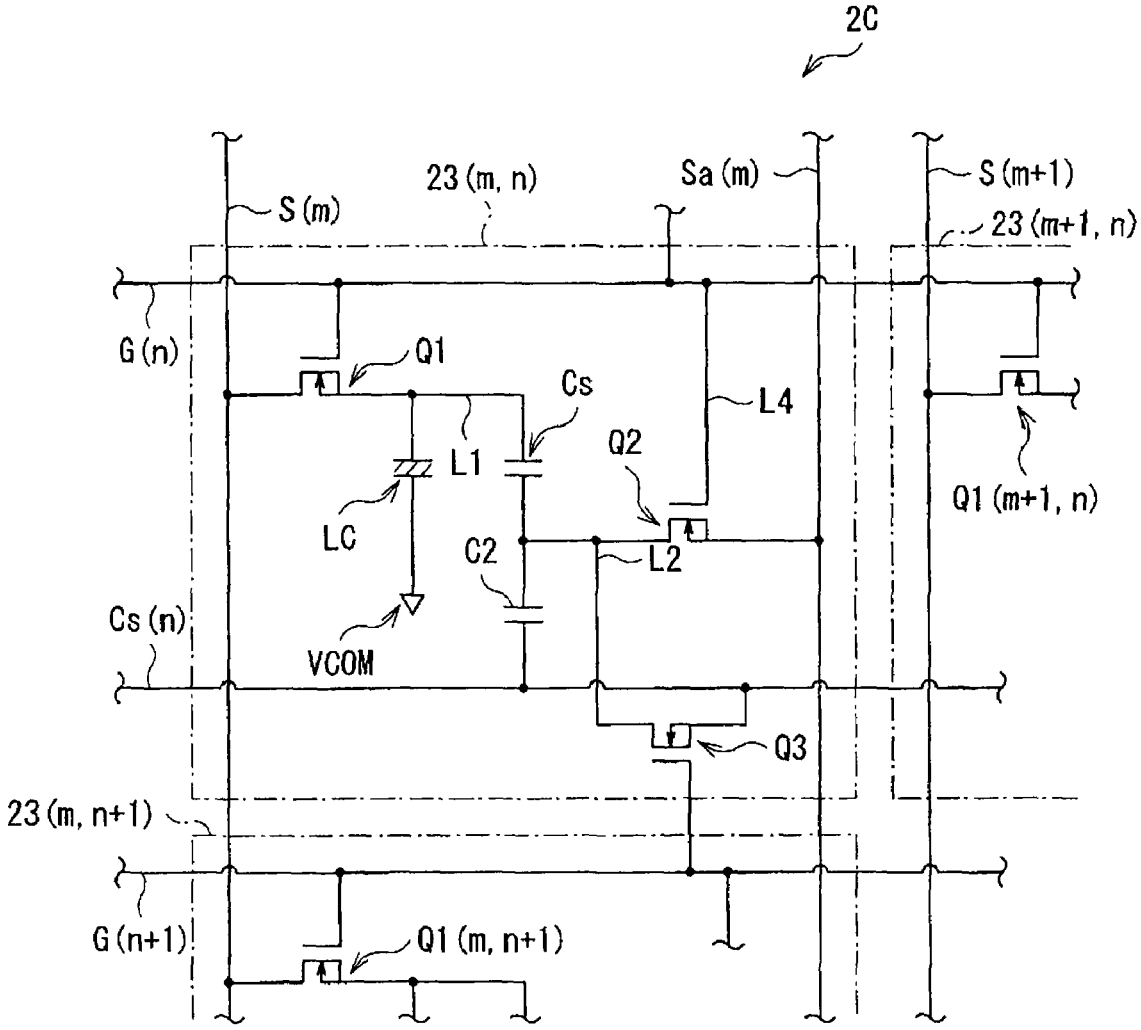
FIG. 16 is a circuit diagram showing the detailed configuration of a pixel circuit unit according to a third modification.
Figure 17:
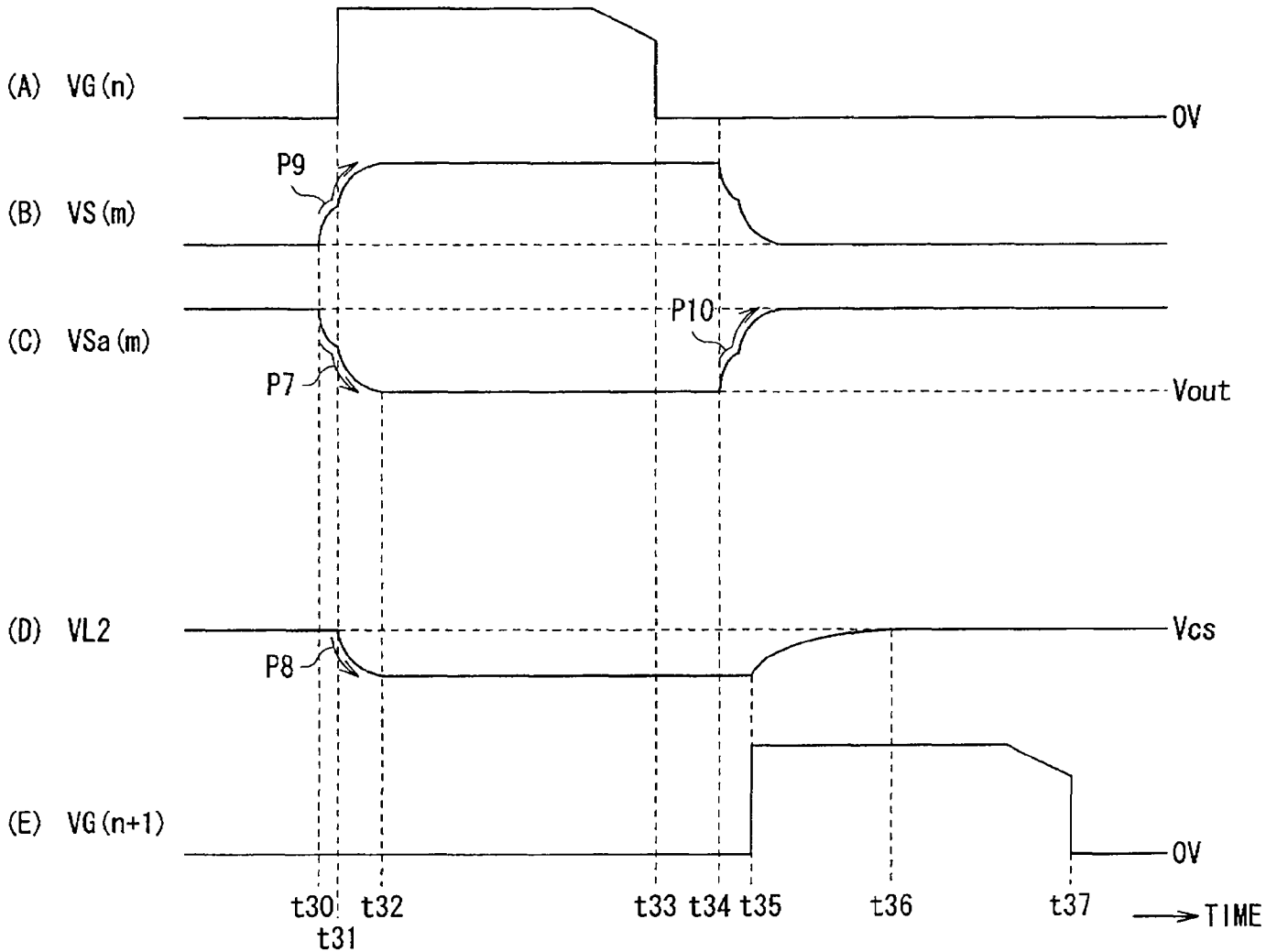
FIG. 17 is a timing waveform diagram showing the driving operation of the pixel circuit unit shown in FIG. 16.

FIG. 16 shows the circuit configuration of a pixel circuit unit formed in an individual pixel 23 of a display panel (a liquid crystal display panel 2C) according to a third modification. FIG. 17 shows the driving operation of the pixel circuit unit according to the third modification by a timing waveform diagram (timings t30 to t37).

The pixel circuit unit within the pixel 23 (m, n) in the third modification is similar to the pixel 20 (m, n) in the foregoing embodiment, except that the source line is composed of two source lines, namely a source line (the main source line) S(m) and an auxiliary source line Sa(m), and therefore neither the capacitive element C1 nor the diode D1 is disposed.

Specifically, the gate of a transistor Q2 of the third modification is connected via a connection line L4 to the gate line G (n), the source thereof is connected to the auxiliary source line Sa(m), and the drain thereof is connected via a connection line L2 to the opposite electrode of an auxiliary capacitive element Cs, one end of a capacitive element C2 and the drain of a transistor Q3. In accordance with a selection signal supplied from a gate driver 52 via the auxiliary gate line G(n), the transistor Q2 functions as a switching element for supplying an auxiliary capacitive voltage Vout (the additional potential) to the opposite electrode of the auxiliary capacitive element Cs. The auxiliary capacitive voltage Vout to be supplied via the auxiliary source line Sa(m) is to be synchronized with an image signal Dout to be supplied via the source line S(m), as shown by the reference numerals P7, P9 and P10 in FIG. 17.

In the third modification having the above configuration, as shown in FIG. 17, in accordance with the selection signal supplied from the gate driver 52 via the gate line G(n) in timings t30 to t32, a selective electrical conduction is made between the auxiliary source line Sa(m) and the opposite electrode of the auxiliary capacitive element Cs within the pixel 23 (m, n), so that the auxiliary capacitive voltage Vout is supplied to the opposite electrode of the auxiliary capacitive element Cs, as shown by the arrows P7 and P8 in FIG. 17. Consequently, the same effect may be obtained by the same operation as the foregoing embodiment. That is, without causing deterioration of the display quality such as display variations between the liquid crystal display pixels, a higher voltage than the original voltage is applied to the liquid crystal display pixels, enabling improvement of the response speed of the liquid crystal element LC.

Additionally, it is not necessary to provide the capacitive element C1 and the diode D1 in the third modification; therefore, the pixel circuit unit configuration is simplified, and the area thereof is reduced than the foregoing embodiment.

Fourth Modification

Figure 18:
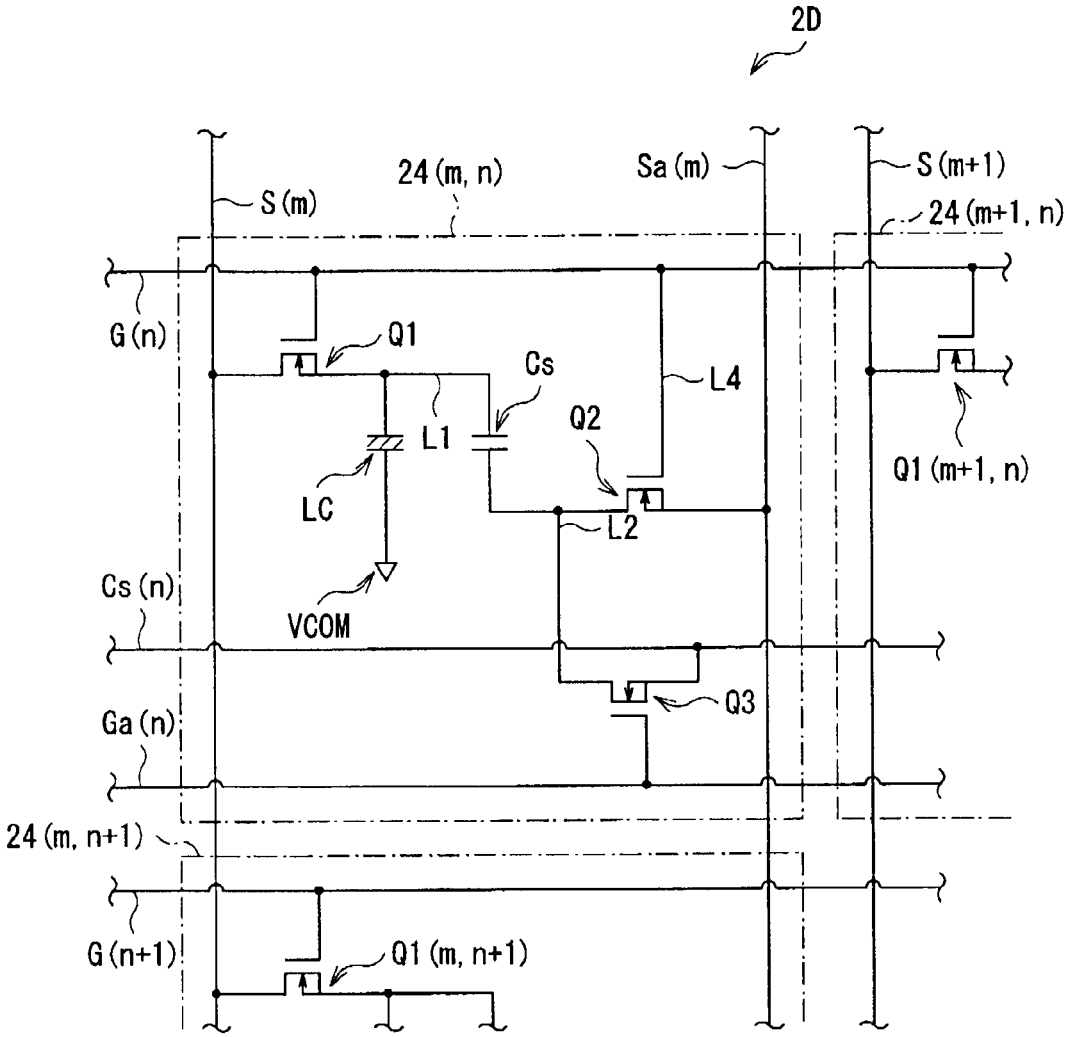
FIG. 18 is a circuit diagram showing the detailed configuration of a pixel circuit unit according to a fourth modification.
Figure 19:
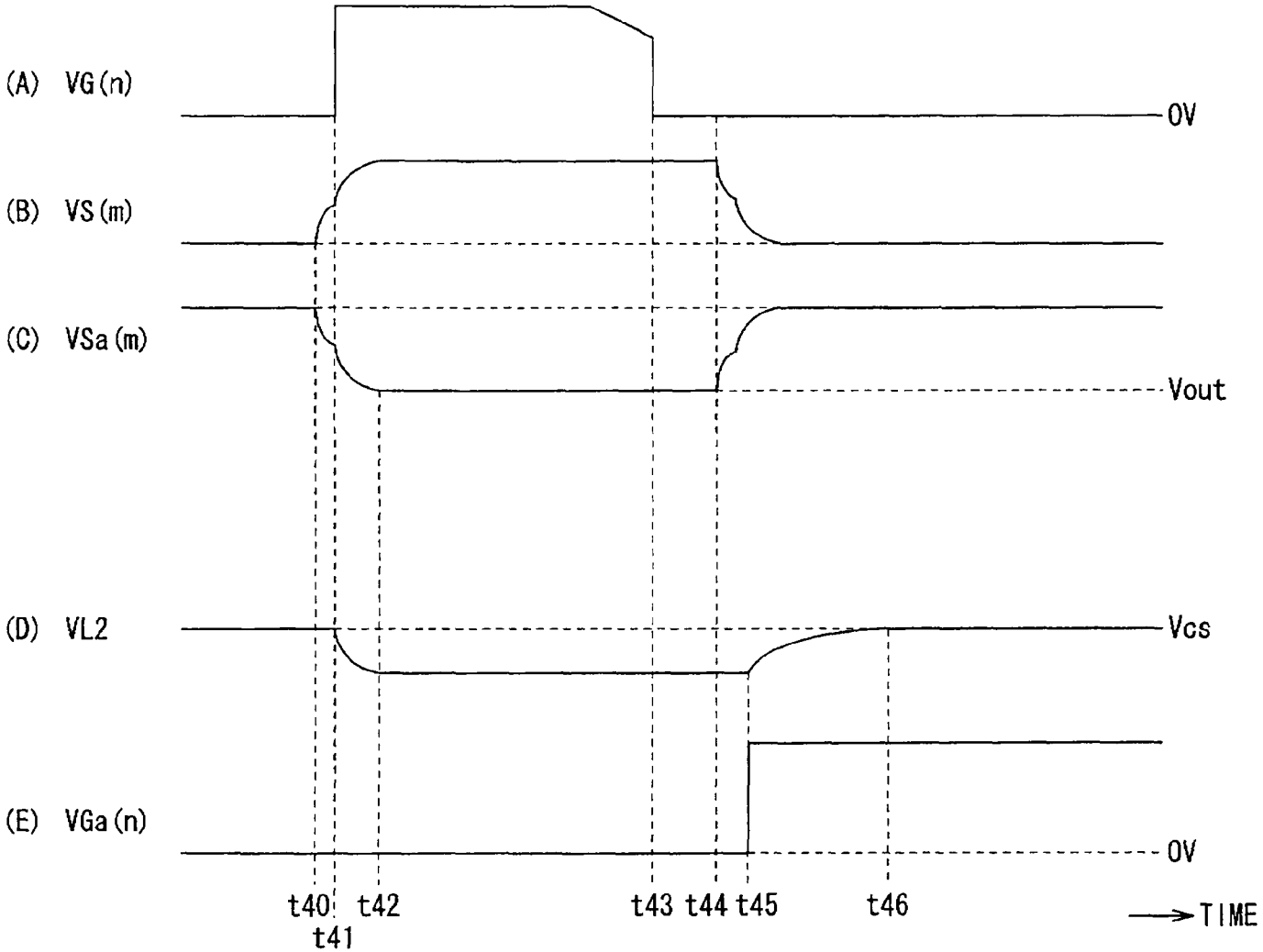
FIG. 19 is a timing waveform diagram showing the driving operation of the pixel circuit unit shown in FIG. 18.

FIG. 18 shows the circuit configuration of a pixel circuit unit formed in an individual pixel 24 of a display panel (a liquid crystal display panel 2D) according to a fourth modification. FIG. 19 shows the driving operation of the pixel circuit unit according to the fourth modification by a timing waveform diagram (timings t40 to t46).

The pixel circuit unit within the pixel 24 (m, n) in the fourth modification is similar to the pixel 20 (m, n) in the foregoing embodiment, except that the gate line is composed of two gate lines, namely a gate line (the main gate line) G(n) and an auxiliary gate line Ga(n), and the source line is composed of two source lines, namely a source line (the main source line) S(m) and an auxiliary source line Sa(m), and therefore, none of the capacitive elements C1 and C2 and the diode D1 is disposed. That is, the fourth modification is a combination of the second and third modifications.

Specifically, the gate of a transistor Q2 of the fourth modification is connected via a connection line L4 to the gate line G(n), the source thereof is connected to the auxiliary source line Sa(m), and the drain thereof is connected via a connection line L2 to the opposite electrode of an auxiliary capacitive element Cs and the drain of a transistor Q3. In accordance with a selection signal supplied from a gate driver 52 via the gate line G(n), the transistor Q2 functions as a switching element for supplying an auxiliary capacitive voltage Vout (the additional potential) to the opposite electrode of the auxiliary capacitive element Cs. In the fourth modification, an auxiliary capacitive voltage Vout to be supplied via the auxiliary source line Sa(m) is to be synchronized with an image signal Dout to be supplied via the source line S(m).

The gate of a transistor Q3 of the fourth modification is connected to the auxiliary gate line Ga(n), the source thereof is connected to an auxiliary capacitive line Cs(n), and the drain thereof is connected via the connection line L2 to the opposite electrode of the auxiliary capacitive element Cs and the drain of the transistor Q2. In accordance with a selection signal supplied from a gate driver 52 via the auxiliary gate line Ga(n), the transistor Q3 functions as a switching element for resetting the opposite electrode of the auxiliary capacitive element Cs to a predetermined reference potential Vcs, after the image signal Dout is supplied from the TFT element Q1.

In the fourth modification having the above configuration, as shown in FIG. 19, in accordance with the selection signal supplied from the gate driver 52 via the gate line G(n) in timings t40 to t42, a selective electrical conduction is made between the auxiliary source line Sa(m) and the opposite electrode of the auxiliary capacitive element Cs within the pixel 24 (m, n), so that the auxiliary capacitive voltage Vout is supplied to the opposite electrode of the auxiliary capacitive element Cs. In accordance with the selection signal supplied from the gate driver 52 via the gate line Ga(n) in timings t45 to t46, a selective electrical conduction is made between the auxiliary capacitive line Cs(n) and the opposite electrode of the auxiliary capacitive element Cs, so that the reference potential Vcs is supplied and reset to the opposite electrode of the auxiliary capacitive element Cs. Consequently, the same effect may be obtained by the same operation as the foregoing embodiment. That is, without causing deterioration of the display quality such as display variations between the liquid crystal display pixels, a higher voltage than the original voltage is applied to the liquid crystal display pixels, enabling improvement of the response speed of the liquid crystal element LC.

Additionally, it is not necessary to provide the capacitive elements C1 and C2 and the diode D1 in the fourth modification; therefore, the pixel circuit unit configuration is simplified, and the area thereof is reduced than the foregoing embodiment.

As described above, though the fourth modification corresponds to the combination of the second and third modifications, it may be a combination of the first and third modifications.

While the present invention has been described by the foregoing embodiment and the several modifications, it is to be understood that the present invention is not limited to these, and many changes and modifications may be made.

For example, though the case where the selection signal DCS is a 2-bit signal has been described in the foregoing embodiment, a 1-bit signal or a 3-bit or more signal may be used. If the selection signal DCS is a 1-bit signal, the auxiliary capacitive voltage Vout is composed of three kinds of voltages Vcs, Vcsp and Vcsn. Accordingly, the voltage generation operation by the auxiliary capacitive generation section 514 is simplified, reducing the processing burden than the foregoing embodiment. On the other hand, if the selection signal DSC is not less than a 3-bit signal, the kinds of the auxiliary capacitive voltage Vout may be increased with increasing the number of bits. This provides more precise control than the foregoing embodiment.

Although the foregoing embodiment is directed to the case where the so-called dot inversion is used to perform display driving of the respective pixel circuit units (the liquid crystal display pixels) in the liquid crystal display panel 2, so-called line inversion or frame inversion may be used to perform display driving. However, in the case where the adjacent source line S(m+1) is shared by time-divisionally to perform the operation of supplying the auxiliary capacitive voltage Vout (in the foregoing embodiment and the first and second modifications), the dot inversion, in which the voltage polarity of the image signal Dout is reversed between the adjacent pixels along the gate line, may require less voltage variation when supplying the proper image signal Dout after the supply of the auxiliary capacitive voltage Vout, than the line inversion or the frame inversion in which the voltage polarity is not reversed. It is therefore possible to suppress the driving capability of the driving section 515 and the like.

Although the foregoing embodiment is directed to the case where the operation of supplying the auxiliary capacitive voltage Vout is performed with respect to the pixel circuit units (the liquid crystal display pixels) having the transition from black display state to white display state when the liquid crystal is VA mode liquid crystal, other selective supply operation may be performed in accordance with the image signal Dout to be supplied to the individual liquid crystal display pixel.

Although the foregoing embodiment is directed to the case where the operation of supplying the auxiliary capacitive voltage Vout is selectively performed in accordance with the image signal Dout to be supplied to the individual liquid crystal display pixel, for example, the luminance variation between the liquid crystal display pixels due to the deterioration with time may be eliminated by recognizing the degree of deterioration in an individual liquid crystal display pixel, and by selectively performing the operation of supplying the auxiliary capacitive voltage Vout in accordance with the degree of the deterioration in the individual liquid crystal display pixel.

Although the liquid crystal display 1 having the liquid crystal display panel 2 has been described as an example of the image display device having the display panel in the foregoing embodiment, the image display device of the present invention is also applicable to image display devices having other display panels, such as plasma display panels (PDPs) and electroluminescence (EL) display devices.

It should be understood by those skilled in the art that various modifications, combinations, sub-combinations and alterations may occur depending on design requirements and other factors insofar as they are within the scope of the appended claims or the equivalents thereof.

What is claimed is:

1. An image display device comprising:

a plurality of pixels each including a main capacitive element as a display element performing display operation in accordance with image data supplied to one end thereof, and an auxiliary capacitive element having one end connected to the one end of the main capacitive element and having another end connected via a second capacitive element at the another end of the auxiliary capacitive element to an auxiliary capacitive line; and driving means for driving each of the pixels, while supplying an additional potential to the other end of the auxiliary capacitive element in each of the pixels, the additional potential being individually determined so that a voltage between both ends of the main capacitive element rises higher than an original voltage, wherein the second capacitive element holds the additional potential supplied to the auxiliary capacitive element.

2. The image display device according to claim 1, wherein polarity of the additional potential is different from polarity of a potential at the one end of the main capacitive element.

3. The image display device according to claim 1, wherein the driving means individually changes the additional potential in accordance with image data supplied to each pixel.

4. The image display device according to claim 3, wherein the driving means individually changes the additional potential in each pixel where luminance level difference between current unit frame and immediately previous unit frame is equal to or over a predetermined threshold value, so that the voltage between both ends of the main capacitive element rises higher than the original voltage.

5. The image display device according to claim 4, wherein the driving means individually changes the additional potential in each pixel where the luminance level difference between current unit frame and immediately previous unit frame is equal to or over a predetermined threshold value, so that the voltage between both ends of the main capacitive element rises in response to increment of the luminance level difference.

6. The image display device according to claim 1, wherein, the main capacitive element is configured of a liquid crystal layer, and the pixels are liquid crystal display pixels.

7. The image display device according to claim 6, wherein the liquid crystal layer is composed of vertical alignment (VA) mode liquid crystal.

8. The image display device according to claim 7, wherein the driving means individually changes the additional potential in each pixel where luminance level changes from black display state to white display state, so that the voltage between both ends of the main capacitive element rises higher than the original voltage.

9. The image display device according to claim 8, wherein, the driving means individually changes the additional potential in each pixel where luminance level changes from black display state to white display state, and the luminance level difference is equal to or over a predetermined threshold value, so that the voltage between both ends of the main capacitive element rises higher than the original voltage.

10. The image display device according to claim 6, wherein each of the liquid crystal display pixels comprises:

a first switching element for switching to supply the image data to the one end of the main capacitive element, which is commonly connected to the one end of the auxiliary capacitive element;

a second switching element for switching to supply the additional potential to the other end of the auxiliary capacitive element in synchronization with a timing of starting supply of the image data through the first switching element; and a third switching element for switching to reset the other end of the auxiliary capacitive element to a predetermined reference potential after completion of supply of the image data through the first switching element.

11. The image display device according to claim 10, wherein, the liquid crystal display pixels are arranged in a matrix, the driving means line-sequentially drives the liquid crystal display pixels, each of the liquid crystal display pixels is connected to:

a gate line for selecting, in a line-sequential manner, the liquid crystal display pixels to be driven, a source line for supplying the image data to the liquid crystal display pixel selected by the gate line, and a reference potential line for resetting the other end of the auxiliary capacitive element to the reference potential, the first switching element makes a selective electrical conduction between the source line and the one end of the main capacitive element, which is commonly connected to the one end of the auxiliary capacitive element, in accordance with a selection signal supplied from the driving means via the gate line, the second switching element temporarily supplies the additional potential by making a selective electrical conduction between an adjacent source line which is a source line for an adjacent liquid crystal display pixel and the other end of the auxiliary capacitive element, in accordance with the selection signal, the third switching element supplies the reference potential by making a selective electrical conduction between the reference potential line and the other end of the auxiliary capacitive element, in accordance with an adjacent selection signal supplied from the driving means via an adjacent gate line which is a gate line for an adjacent liquid crystal display pixel, and each of the liquid crystal display pixels further comprises:

a first capacitive element for supplying the selection signal in a pulse form to the second switching element, and a discharge element for making a selective disconnection between the adjacent source line and the other end of the auxiliary capacitive element by causing the second switching element to enter the off state.

12. The image display device according to claim 10, wherein, the liquid crystal display pixels are arranged in a matrix, the driving means line-sequentially drives the liquid crystal display pixels, each of the liquid crystal display pixels is connected to:

a main gate line and an auxiliary gate line both for selecting, in a line-sequential manner, the liquid crystal display pixels to be driven, a source line for supplying the image data to the liquid crystal display pixel selected by the main gate line and the auxiliary gate line, and a reference potential line for resetting the other end of the auxiliary capacitive element to the reference potential, the first switching element makes a selective electrical conduction between the source line and the one end of the main capacitive element, which is commonly connected to the one end of the auxiliary capacitive element, in accordance with a main selection signal supplied from the driving means via the main gate line, the second switching element temporarily supplies the additional potential by making a selective electrical conduction between an adjacent source line which is a source line for an adjacent liquid crystal display pixel and the other end of the auxiliary capacitive element, in accordance with an auxiliary selection signal supplied from the driving means via the auxiliary gate line, and the third switching element supplies the reference potential by making a selective electrical conduction between the reference potential line and the other end of the auxiliary capacitive element, in accordance with an adjacent main selection signal supplied from the driving means via an adjacent main gate line which is a main gate line for an adjacent liquid crystal display pixel.

13. The image display device according to claim 10, wherein, the liquid crystal display pixels are arranged in a matrix, the driving means line-sequentially drives the liquid crystal display pixels, each of the liquid crystal display pixels is connected to:

a main gate line and an auxiliary gate line both for selecting, in a line-sequential manner, the liquid crystal display pixels to be driven, a source line for supplying the image data to the liquid crystal display pixel selected by the main gate line and the auxiliary gate line, and a reference potential line for resetting the other end of the auxiliary capacitive element to the reference potential, the first switching element makes a selective electrical conduction between the source line and the one end of the main capacitive element, which is commonly connected to the one end of the auxiliary capacitive element, in accordance with a main selection signal supplied from the driving means via the main gate line, the second switching element temporarily supplies the additional potential by making a selective electrical conduction between an adjacent source line which is a source line for an adjacent liquid crystal display pixel and the other end of the auxiliary capacitive element, in accordance with the main selection signal, the third switching element supplies the reference potential by making a selective electrical conduction between the reference potential line and the other end of the auxiliary capacitive element, in accordance with an auxiliary selection signal supplied from the driving means via the auxiliary gate line, and each of the liquid crystal display pixels further comprises:

a capacitive element for supplying the main selection signal in a pulse form to the second switching element, and a discharge element for making a selective disconnection between the adjacent source line and the other end of the auxiliary capacitive element by causing the second switching element to enter the off state.

14. The image display device according to claim 10, wherein, the liquid crystal display pixels are arranged in a matrix, the driving means line-sequentially drives the liquid crystal display pixels, each of the liquid crystal display pixels is connected to:

a gate line for selecting, in a line-sequential manner, the liquid crystal display pixels to be driven, a main source line and an auxiliary source line, the main source line supplying the image data to the liquid crystal display pixel selected by the gate line, and a reference potential line for resetting the other end of the auxiliary capacitive element to the reference potential, the first switching element makes a selective electrical conduction between the main source line and the one end of the main capacitive element, which is commonly connected to the one end of the auxiliary capacitive element, in accordance with a selection signal supplied from the driving means via the gate line, the second switching element supplies the additional potential by making a selective electrical conduction between the auxiliary source line and the other end of the auxiliary capacitive element, in accordance with the selection signal, and the third switching element supplies the reference potential by making a selective electrical conduction between the reference potential line and the other end of the auxiliary capacitive element, in accordance with an adjacent selection signal supplied from the driving means via an adjacent gate line which is a gate line for an adjacent liquid crystal display pixel.

15. The image display device according to claim 10, wherein, the liquid crystal display pixels are arranged in a matrix, the driving means line-sequentially drives the liquid crystal display pixels, each of the liquid crystal display pixels is connected to:

a main gate line and an auxiliary gate line both for selecting, in a line-sequential manner, the liquid crystal display pixels to be driven, a main source line and an auxiliary source line, the main source line supplying the image data to the liquid crystal display pixel selected by the main gate line and the auxiliary gate line, and a reference potential line for resetting the other end of the auxiliary capacitive element to the reference potential, the first switching element makes a selective electrical conduction between the main source line and the one end of the main capacitive element, which is commonly connected to the one end of the auxiliary capacitive element, in accordance with a main selection signal supplied from the driving means via the main gate line, the second switching element supplies the additional potential by making a selective electrical conduction between the auxiliary source line and the other end of the auxiliary capacitive element, in accordance with the main selection signal, and the third switching element supplies the reference potential by making a selective electrical conduction between the reference potential line and the other end of the auxiliary capacitive element, in accordance with an auxiliary selection signal supplied from the driving means via the auxiliary gate line.

16. A display panel comprising:

a plurality of pixels arranged side by side, each including a main capacitive element as a display element performing display operation in accordance with image data supplied to one end thereof; and an auxiliary capacitive element having one end connected to the one end of the main capacitive element and having another end connected via a second capacitive element at the another end of the auxiliary capacitive element to an auxiliary capacitive line, wherein, the other end of the auxiliary capacitive element in each of the pixels is supplied with an additional potential which is individually determined so that a voltage between both ends of the main capacitive element rises higher than an original voltage, and the second capacitive element holds the additional potential supplied to the auxiliary capacitive element.

17. A method of driving an image display device having a plurality of pixels, each of the pixels including a main capacitive element as a display element performing display operation in accordance with image data supplied to one end thereof, and an auxiliary capacitive element having one end connected to the one end of the main capacitive element and having another end connected via a second capacitive element at the another end of the auxiliary capacitive element to an auxiliary capacitive line, the method comprising a process of driving each of the pixels, the process comprising:

supplying the image data to the one end of the main capacitive element, which is commonly connected to the one end of the auxiliary capacitive element;

supplying an additional potential to the other end of the auxiliary capacitive element in each of the pixels in synchronization with a timing of starting supply of the image data, the additional potential being individually determined so that a voltage between both ends of the main capacitive element rises higher than an original voltage; and resetting the other end of the auxiliary capacitive element to a predetermined reference potential after completion of supply of the image data, wherein the second capacitive element holds the additional potential supplied to the auxiliary capacitive element.

18. An image display device comprising:

a plurality of pixels each including a main capacitive element as a pixel performing display operation in accordance with image data supplied to one end thereof, and an auxiliary capacitive element having one end connected to the one end of the main capacitive element and having another end connected via a second capacitive element at the another end of the auxiliary capacitive element to an auxiliary capacitive line; and a driving section driving each of the pixels, while supplying an additional potential to the other end of the auxiliary capacitive element in each of the pixels, the additional potential being individually determined so that a voltage between both ends of the main capacitive element rises higher than an original voltage, wherein the second capacitive element holds the additional potential supplied to the auxiliary capacitive element.

* * * * *